US011686521B2

(12) United States Patent
Han et al.

(10) Patent No.: US 11,686,521 B2
(45) **Date of Patent: *Jun. 27, 2023**

(54) REFRIGERATOR

(71) Applicant: LG ELECTRONICS INC., Seoul (KR)

(72) Inventors: Junsoo Han, Seoul (KR); Dongseok Kim, Seoul (KR); Kangsoo Byun, Seoul (KR); Younseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 266 days.

This patent is subject to a terminal disclaimer.

(21) Appl. No.: 17/004,258

(22) Filed: Aug. 27, 2020

(65) Prior Publication Data

US 2020/0393188 A1 Dec. 17, 2020

Related U.S. Application Data

(63) Continuation of application No. 16/573,163, filed on Sep. 17, 2019, now Pat. No. 10,788,255, which is a (Continued)

(30) Foreign Application Priority Data

Sep. 29, 2016 (KR) ..... 10-2016-0125941

(51) Int. Cl.
*F25D 17/06* (2006.01)
*F25D 11/02* (2006.01)
(Continued)

(52) U.S. Cl.
CPC ..... *F25D 17/065* (2013.01); *F25D 11/02* (2013.01); *F25D 21/08* (2013.01); *F25D 21/14* (2013.01);
(Continued)

(58) Field of Classification Search
CPC ..... F25D 17/065; F25D 17/067; F25D 17/08; F25D 11/02; F25D 21/08; F25D 21/14;
(Continued)

(56) References Cited

U.S. PATENT DOCUMENTS 3,310,957 A * 3/1967 Saunders ..... F25D 17/065 62/419
3,393,530 A 7/1968 Koch
(Continued)

FOREIGN PATENT DOCUMENTS

CN 201159564 12/2008
CN 101688721 3/2010
(Continued)

OTHER PUBLICATIONS

Chinese Notice of Allowance dated Sep. 2, 2021 issued in CN Application No. 202010993333.4.
(Continued)

*Primary Examiner* — Emmanuel E Duke
(74) *Attorney, Agent, or Firm* — Ked & Associates, LLP

(57) ABSTRACT

A refrigerator includes a first storage chamber, a second storage chamber, and a heat exchange chamber therebetween. At least one first inlet is configured to introduce cold air from the first storage chamber into the heat exchange chamber, and at least one second inlet is configured to introduce cold air from the second storage chamber into the heat exchange chamber. The first and second inlets are provided at sides of the refrigerator.

20 Claims, 19 Drawing Sheets

Related U.S. Application Data continuation of application No. 15/673,505, filed on Aug. 10, 2017, now Pat. No. 10,473,379.

(51) Int. Cl.
*F25D 21/08* (2006.01)
*F25D 21/14* (2006.01)
*F25D 23/06* (2006.01)

(52) U.S. Cl.
CPC .... *F25D 23/066* (2013.01); *F25D 2317/0653* (2013.01); *F25D 2317/0681* (2013.01); *F25D 2321/144* (2013.01)

(58) Field of Classification Search
CPC ..... F25D 23/066; F25D 23/006; F25D 2317/0653; F25D 2317/0681; F25D 2321/144; F25D 2317/0654; F25D 2317/068; F25D 2317/0663; F25D 2317/0664; F25D 2317/067
See application file for complete search history.

(56) References Cited

U.S. PATENT DOCUMENTS

| | | | | |
|---|---|---|---|---|
| 3,834,177 | A | 9/1974 | Scarlett | |
| 4,671,074 | A * | 6/1987 | Gostelow | F25D 23/063 62/186 |
| 5,255,536 | A | 10/1993 | Jung et al. | |
| 5,715,703 | A * | 2/1998 | Kopf | F25D 17/065 62/186 |
| 5,722,252 | A | 3/1998 | Kang | |
| 2011/0011118 | A1* | 1/2011 | Cho | F25D 17/067 62/515 |
| 2013/0000333 | A1* | 1/2013 | Kim | F25D 17/065 62/407 |
| 2015/0362245 | A1* | 12/2015 | Kuehl | F25B 5/02 62/117 |
| 2016/0047591 | A1 | 2/2016 | Jeong et al. | |

FOREIGN PATENT DOCUMENTS

| | | |
|---|---|---|
| CN | 102428331 | 4/2012 |
| CN | 102460048 | 5/2012 |
| CN | 102472550 | 5/2012 |
| CN | 104024772 | 9/2014 |
| CN | 105333672 | 2/2016 |
| CN | 105371550 | 3/2016 |
| CN | 105627669 | 6/2016 |
| DE | 10 2014 218 411 | 3/2016 |
| EP | 2 778 575 | 9/2014 |
| EP | 2 694 894 | 3/2016 |
| GB | 2 251 295 | 7/1992 |
| JP | S 52-37251 | 3/1977 |
| JP | S 60-4883 | 1/1985 |
| JP | S 60-181568 | 9/1985 |
| KR | 10-0694259 | 3/2007 |
| KR | 10-2011-0006996 | 1/2011 |
| KR | 10-2011-0006998 | 1/2011 |
| WO | WO 2009/000737 | 12/2008 |
| WO | WO 2011/002182 | 1/2011 |
| WO | WO 2011-007960 | 1/2011 |
| WO | WO 2012/136532 | 10/2012 |
| WO | WO 2015/074835 | 5/2015 |
| WO | WO 2016/041791 | 3/2016 |

OTHER PUBLICATIONS

European Search Report dated Nov. 10, 2017 issued in Application No. 17188949.6.
U.S. Office Action dated Mar. 5, 2019 issued in U.S. Appl. No. 15/673,505.
U.S. Notice of Allowance dated Jun. 20, 2019 issued in U.S. Appl. No. 15/673,505.
Chinese Office Action (with English translation) dated Aug. 5, 2019 issued in CN Application No. 201710806237.2.
U.S. Quayle Office Action dated Apr. 6, 2020 issued in U.S. Appl. No. 16/573,163.
U.S. Notice of Allowance dated May 14, 2020 issued in U.S. Appl. No. 16/573,163.
Korean Office Action dated Mar. 31, 2023 issued in Application No. 10-2016-0125941.

* cited by examiner

REFRIGERATOR

CROSS-REFERENCE TO RELATED APPLICATION

This application is a Continuation of U.S. application Ser. No. 16/573,163, filed Sep. 17, 2019, which is a Continuation of U.S. application Ser. No. 15/673,505, filed Aug. 10, 2017, which claims priority under 35 U.S.C. 119 and 35 U.S.C. 365 to Korean Patent Application No. 10-2016-0125941 filed on Sep. 29, 2016 in Korea, the entire contents of which are hereby incorporated by reference.

BACKGROUND

1. Field

The present disclosure relates to a refrigerator.

2. Background

In general, a refrigerator includes a plurality of storage chambers in which stored goods are accommodated in a frozen state or a refrigerated state, and surfaces of the storage chambers are opened such that the food can be withdrawn. The plurality of storage chambers include a freezing chamber configured to store food in a frozen state and a refrigerating chamber configured to store food in a refrigerated state.

A refrigeration system in which refrigerant circulates is operated in the refrigerator. Devices constituting the refrigeration system include a compressor, a condenser, an expansion device and an evaporator. The refrigerant may be evaporated while passing through the evaporator, and in this process, air passing through the vicinity of the evaporator may be cooled. Further, the cooled air may be supplied to the freezing chamber or the refrigerating chamber. In general, the evaporator is installed on a rear side of the storage chambers and extends vertically.

In recent years, enlarging an inner storage space, specifically, the storage chambers, of the refrigerator is a main concern of consumers. Thus, there have been a large number of efforts to reduce space accommodating components of the refrigeration system required in the refrigerator and to relatively increase the volumes of the storage chambers. However, as described above, when the evaporator is provided on the rear side of the storage chambers, there is a difficulty in that the sizes of the storage chambers used to be reduced to secure a space for installation of the evaporator.

In particular, the refrigerator includes drawers that may be withdrawn forward from the storage chambers. There is a problem in that as the sizes, in particular, the front to-back lengths, of the storage chambers are reduced due to arrangement of the evaporator, and accordingly, the withdrawal distances of the drawers are reduced. When the withdrawal distances of the drawers are reduced, a drawer spaced is reduced, and it is inconvenient for a user to accommodate food in the drawers.

To solve the above-described problems, installing the evaporator in a partition wall by which the refrigerating chamber and the freezing chamber are partitioned has been developed. In a side-by-side refrigerator in which a freezing chamber and a refrigerating chamber are arranged on left and right sides of the refrigerator, because a partition wall vertically extends between the freezing chamber and the refrigerating chamber, defrosting water generated by an evaporator may be easily discharged. However, in a refrigerator in which a refrigerating chamber and a freezing chamber are arranged on upper and lower sides of the refrigerator, because a partition wall transversely extends between the freezing chamber and the refrigerating chamber, it is difficult to discharge defrosting water generated by an evaporator.

Information on the related art will be described below.

1. European Patent No. EP 2,694,894 (published on Mar. 23, 2016)

2. Title of the invention: COMBINATION DEVICE FOR REFRIGERATION

A technology of installing an evaporator in a partition wall by which a refrigerating chamber and a freezing chamber are separated from each other in a refrigerator in which the refrigerating chamber is located at an upper portion of the refrigerator and the freezing chamber is located at a lower portion of the refrigerator is disclosed in the above related art. However, the evaporator according to the related art is inclined downwards toward a rear end. Such arrangement of the evaporator is to easily discharge defrosting water generated by the evaporator to a lower side. However, because the evaporator is inclined toward the rear end, the thickness of the partition wall for arranging an insulator and the evaporator may be increased. When the thickness of the partition wall is increased, storage chambers of the refrigerator become relatively smaller.

Further, a lower surface of the partition wall is inclined downward due to the inclined arrangement of the evaporator, and correspondingly, a side surface of a drawer provided at an upper portion of the freezing chamber is inclined downward toward the rear end. In this case, storage ability for food deteriorates.

According to the arrangement of the evaporator according to the related art, because a fan is located directly behind the evaporator, the defrosting water generated by the evaporator flows into the fan, and thus the fan may malfunction. Further, when cold air having high humidity passes through the fan, condensed water may be generated in the fan. According to the related art, a separate water passage to discharge the condensed water of the fan is not provided, and the condensed water flows to a duct to which the cold air is supplied. In this case, frost caused by the condensed water is in the duct.

A tray collecting the defrosting water must to be provided on a lower side of the evaporator. According to the arrangement of the evaporator according the related art, to decrease the thickness of the partition wall as much as possible, the tray should be provided on the lower side of the evaporator to be very close to the evaporator. In this case, because the defrosting water stored in the tray is frosted, heat exchange performance of the evaporator deteriorates.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Hereinafter, detailed embodiments of the present disclosure will be described with reference to the accompanying drawings. However, the spirit of the present disclosure is not limited to the proposed embodiments, and those skilled in the art who understand the spirit of the present disclosure may easily propose other embodiments within the same scope of the spirit.

Figure 1:
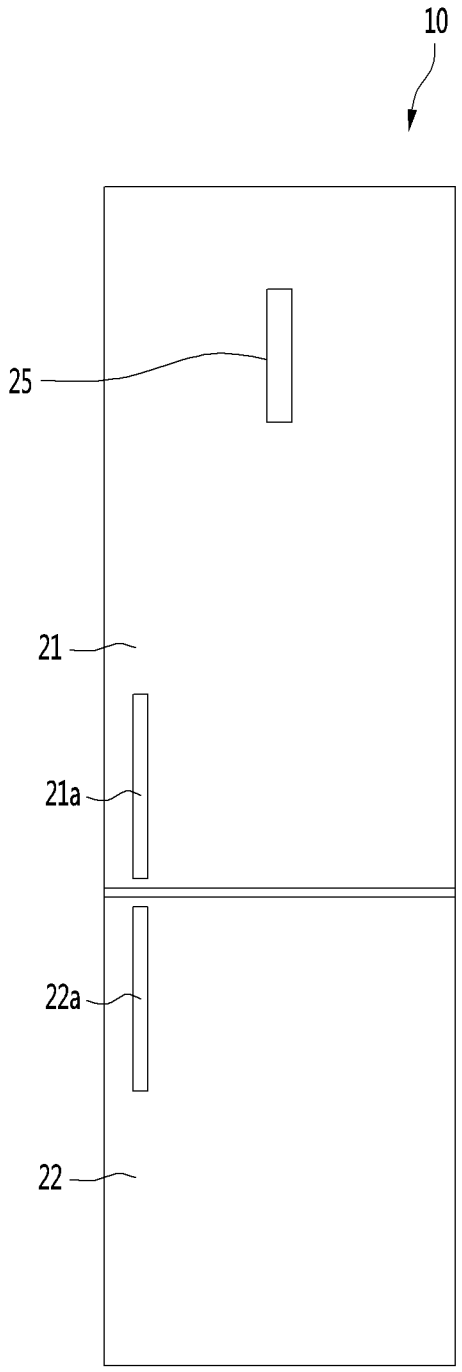
FIG. 1 is a front view illustrating a configuration of a refrigerator according to an embodiment of the present disclosure.
Figure 2:
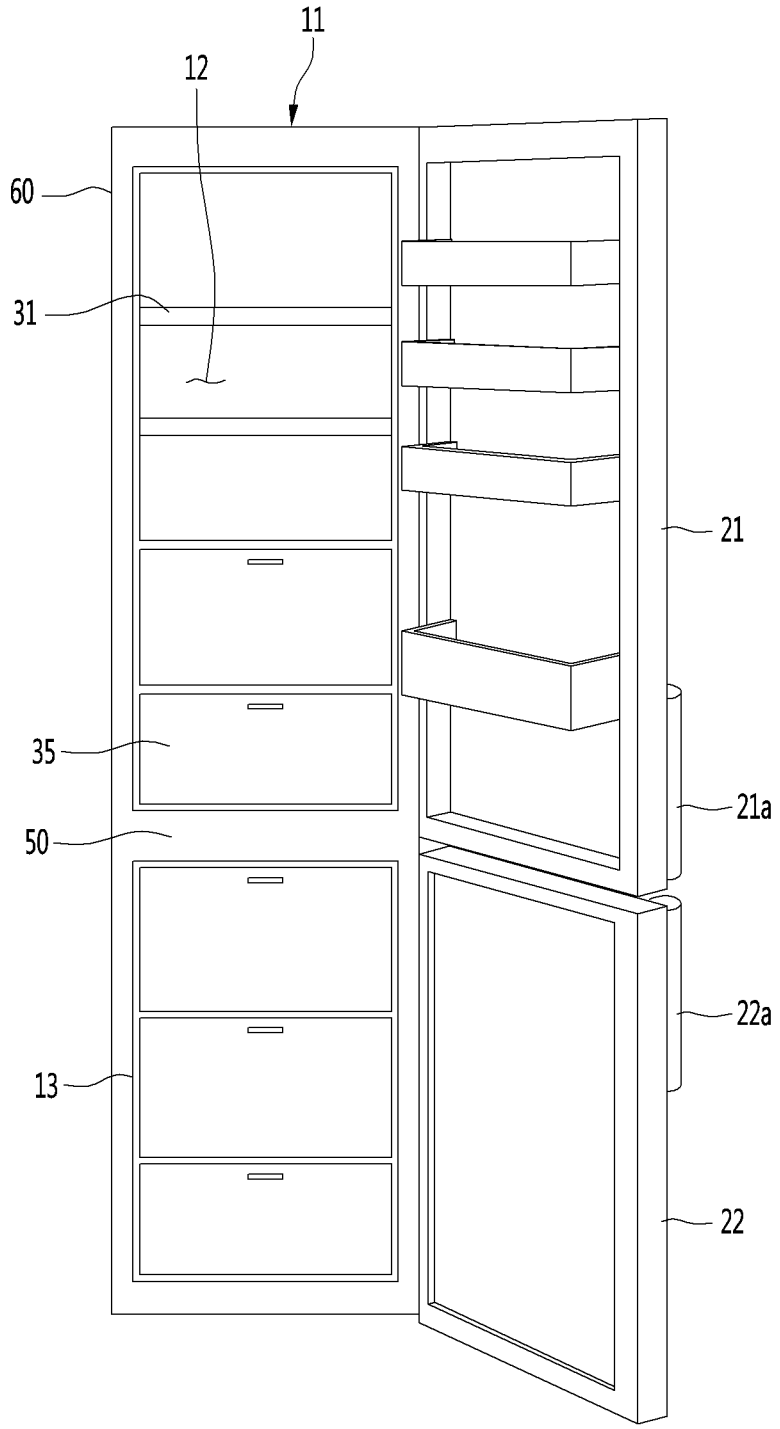
FIG. 2 is a front view illustrating the refrigerator, doors of which are opened, according to the embodiment.
Figure 3:
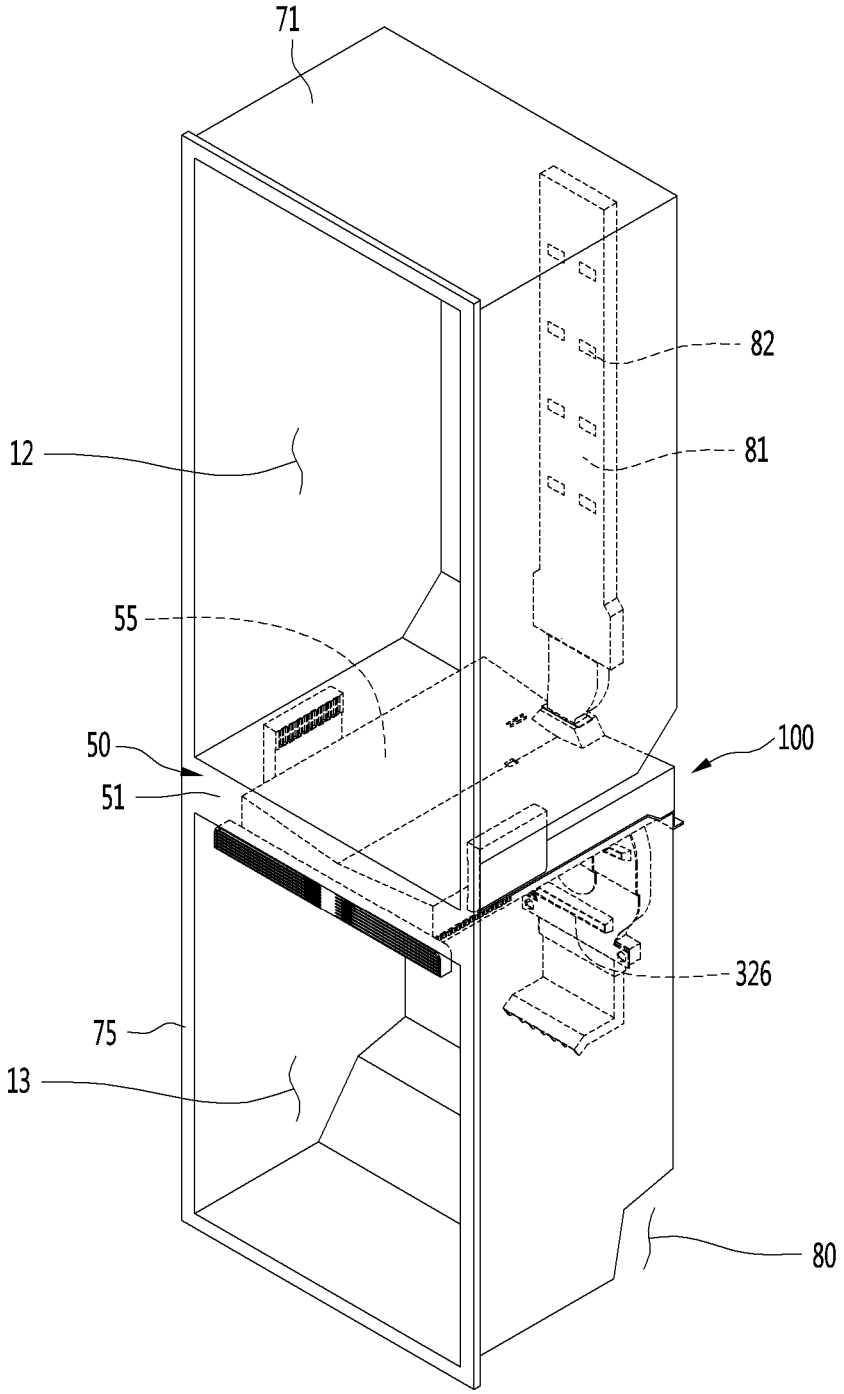
FIG. 3 illustrates an inner case and a cold air supplying device that are provided in the refrigerator according to the embodiment.

Referring to FIGS. 1 to 3, a refrigerator 10 according to an embodiment may include a cabinet 11 in which storage chambers are provided and doors 21 and 22 provided on a front surface of the cabinet 11 to selectively open/close the storage chambers. The cabinet 11 may have a rectangular parallelepiped shape, a front surface of which is open. Further, the cabinet 11 may include an outer case 60 defining an outer appearance of the refrigerator and inner cases 70 coupled to an inside of the outer case 60 and defining inner surfaces of the storage chambers. A cabinet insulator 65 (see FIG. 18) configured to perform insulation between an outside of the refrigerator and the storage chambers may be provided between the outer case 60 and the inner cases 70.

The storage chamber may include first and second storage chambers 12 and 13 controlled to have different temperatures. The first storage chamber 12 may include refrigerating chamber 12, and the second storage chamber 13 may be a freezing chamber 13. As an example, the refrigerating chamber 12 may be formed at an upper portion of the cabinet 11 and the freezing chamber 13 may be formed at a lower portion of the cabinet 11.

The refrigerating chamber 12 may be arranged above the freezing chamber 13. According to such a configuration, because the refrigerating chamber 12 relatively frequently used to store or withdraw food may be arranged at a height corresponding to a waist of a user, the user needs not to bend his/her waist when the refrigerating chamber 12 is used, so that user convenience may be improved.

The refrigerator 10 may further include a partition wall 50 by which the refrigerating chamber 12 and the freezing chamber 13 are partitioned. The partition wall 50 may be provided in the cabinet 11 to extend from a front side toward a rear side of the cabinet 11.

As an example, the partition wall 50 may extend from the front side toward the rear side of the cabinet 11 in a direction that is parallel to the ground. Because temperatures formed at the refrigerating chamber 12 and the freezing chamber 13 are different from each other, a partition wall insulator 55 configured to insulate the refrigerating chamber 12 and the freezing chamber 13 from each other may be provided in the partition wall 50.

The doors 21 and 22 may include a refrigerating chamber door 21 rotatably provided on a front side of the refrigerating chamber 12 and a freezing chamber door 22 rotatably provided on a front side of the freezing chamber 13. As another example, the freezing chamber door 22 may be a drawer capable of being withdrawn forward. A first handle 21*a* that the user may grip may be provided on a front surface of the refrigerating chamber door 21, and a second handle 22*a* may be provided on a front surface of the freezing chamber door 22.

The refrigerator 10 may further include a plurality of shelves 31 provided in the storage chambers to accommodate food. As an example, the plurality of shelves 31 may be provided in the refrigerating chamber 12 to be vertically spaced apart from each other.

The refrigerator 10 may further include drawers 35 capable of being withdrawn from the storage chambers. The drawers 35 may be provided in the refrigerating chamber 12 and the freezing chamber 13, and may have accommodation spaces for food formed therein. The front-rear lengths of the drawers 35 may be increased as the front-rear widths of the storage chambers become larger, and accordingly, the withdrawal distances of the drawers 35 may be increased.

When the withdrawal distances of the drawers 35 are increased, convenience for the user to accommodate food may be improved. Thus, it is important in terms of user convenience that the refrigerator is configured such that the front-rear widths of the storage chambers may become relatively larger.

A direction in which the drawers 35 are withdrawn is defined as a forward direction, and a direction in which the drawers 35 are accommodated is defined as a rearward direction. Further, a leftward direction when the refrigerator 10 is viewed from a front side of the refrigerator 10 is defined as a leftward direction, and a rightward direction when the refrigerator 10 is viewed from the front side of the refrigerator 10 is defined as a rightward direction. The definition of the directions may be identically applied throughout the specification.

The refrigerator 10 may further include a display unit or display 25 configured to display information on the temperatures and operating states of the storage chambers of the refrigerator. As an example, the display 25 may be provided on the front surface of the refrigerating chamber door 21.

The inner cases 70 may include an inner refrigerating chamber case 71 defining the refrigerating chamber 12. The inner refrigerating camber case 71 may have an opened front surface and may have an approximately rectangular parallelepiped shape.

The inner cases 70 may further include an inner freezing chamber case 75 defining the freezing chamber 12. The inner freezing chamber case 75 may have an opened front surface and may have an approximately rectangular parallelepiped shape. The inner freezing chamber case 75 may be arranged below the inner refrigerating chamber case 71 to be spaced apart from the inner refrigerating chamber case 71. The inner refrigerating chamber case 71 may be named a "first inner case", and the inner freezing chamber case 75 may be named a "second inner case".

The partition wall 50 may be arranged between the inner refrigerating chamber case 71 and the inner freezing chamber case 75. The partition wall 50 may include a front partition wall part (or first partition wall) 51 defining a front outer appearance of the partition wall 50. When the doors 21 and 22 are opened, the front partition wall 51 may be located between the refrigerating chamber 12 and the freezing chamber 13 when viewed from the outside.

The partition wall 50 may further include the partition wall insulator 55 provided on a rear side of the front partition wall 51 to insulate the refrigerating chamber 12 and the freezing chamber 13. The partition wall insulator 55 may be arranged between a bottom surface of the inner refrigerating chamber case 71 and an upper surface of the inner freezing chamber case 75. The partition wall 50 may include the bottom surface of the inner refrigerating chamber case 71 and the upper surface of the inner freezing chamber case 75.

The refrigerator 10 may include a cold air supplying device (or cold air supply) 100 configured to supply cold air to the refrigerating chamber 12 and the freezing chamber 13. The cold air supply 100 may be arranged below the partition wall insulator 55. The cold air supply 100 may be installed on an inner upper surface of the inner freezing chamber case 75.

The cold air generated by the cold air supply 100 may be supplied to the refrigerating chamber 12 and the freezing chamber 13, respectively. A refrigerating chamber cold air duct 81 through which at least a portion of the cold air generated by the cold air supply 100 flows may be provided on a rear side of the refrigerating chamber 12.

Further, refrigerating chamber cold air supplying parts or ports 82 configured to supply the cold air to the refrigerating chamber 12 may be formed in the refrigerating chamber cold air duct 81. The refrigerating chamber cold air duct 81 may be formed on a rear wall of the refrigerating chamber 12, and the refrigerating chamber cold air supplying ports 82 may be formed on a front surface of the refrigerating chamber cold air duct 81.

The cold air supply 100 may include a freezing chamber cold air supplying unit configured to supply at least a portion of the cold air generated by the cold air supply 100 to the freezing chamber 13. The freezing chamber cold air supplying unit may include a second supply unit (or freezing chamber air supply) 326. Descriptions related thereto will be made with reference to the accompanying drawings.

A machine room 80 may be formed on a lower rear side of the inner freezing chamber case 75. A compressor and an evaporator as components constituting a refrigeration cycle may be installed in the machine room 80.

Figure 4:
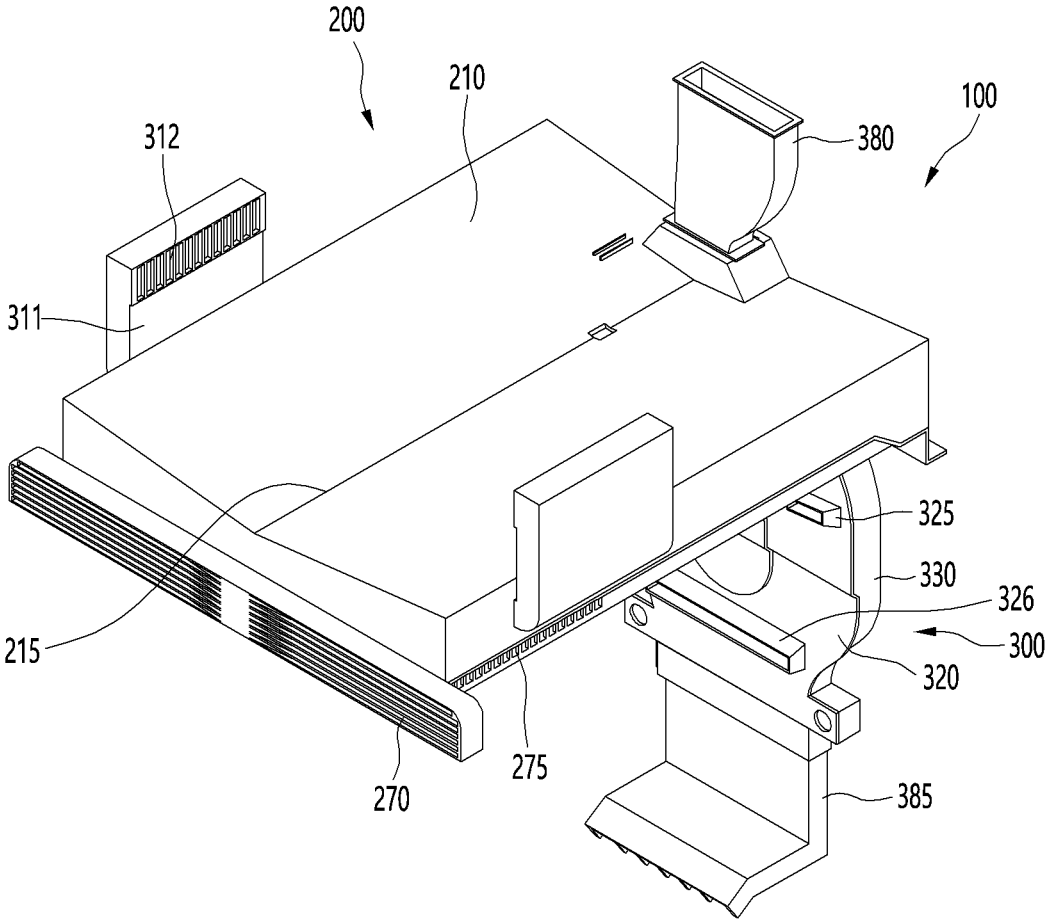
FIG. 4 illustrates a configuration of the cold air supplying device according to the embodiment.
Figure 5:
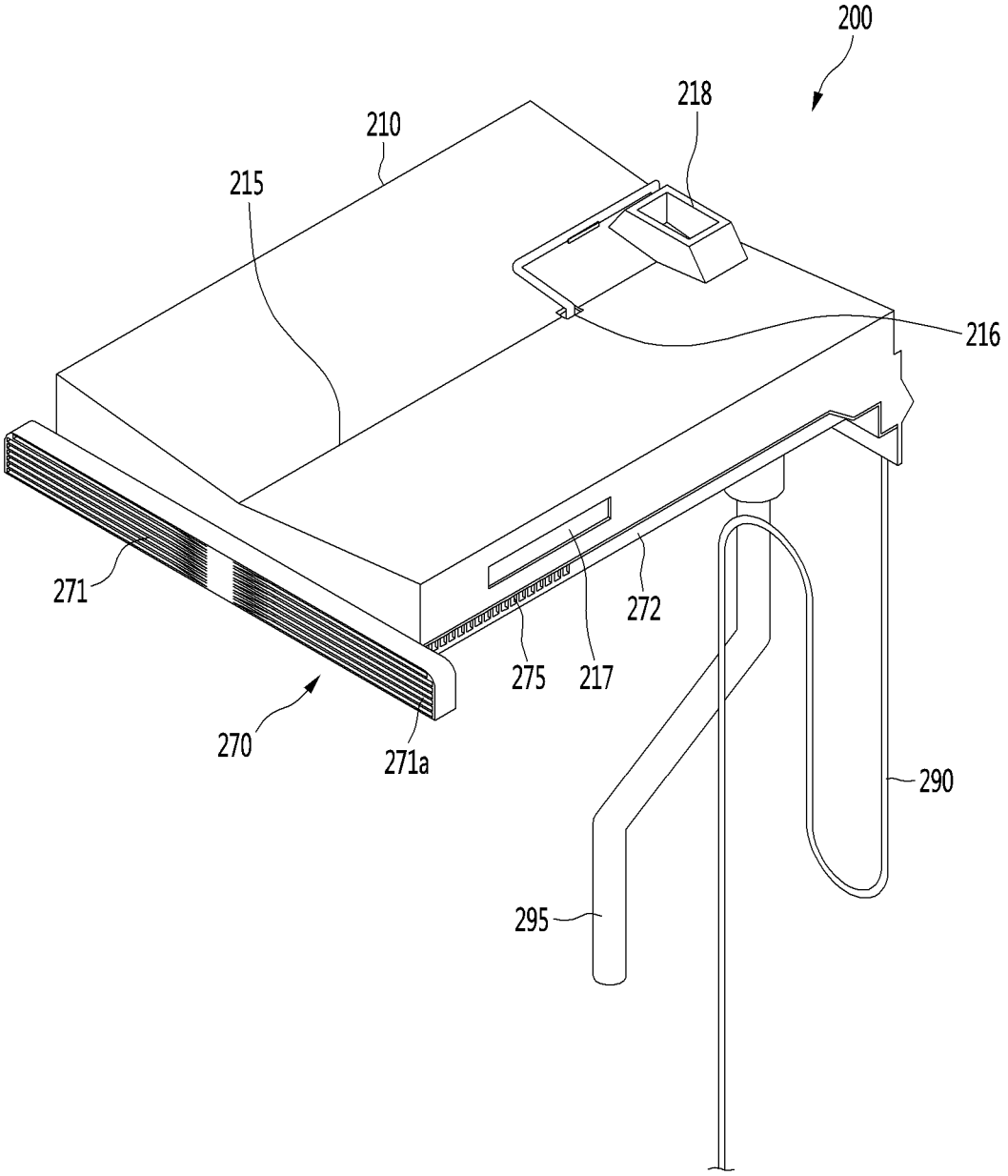
FIG. 5 illustrates a configuration of a cold air generator in the cold air supplying device according to the embodiment.
Figure 6:
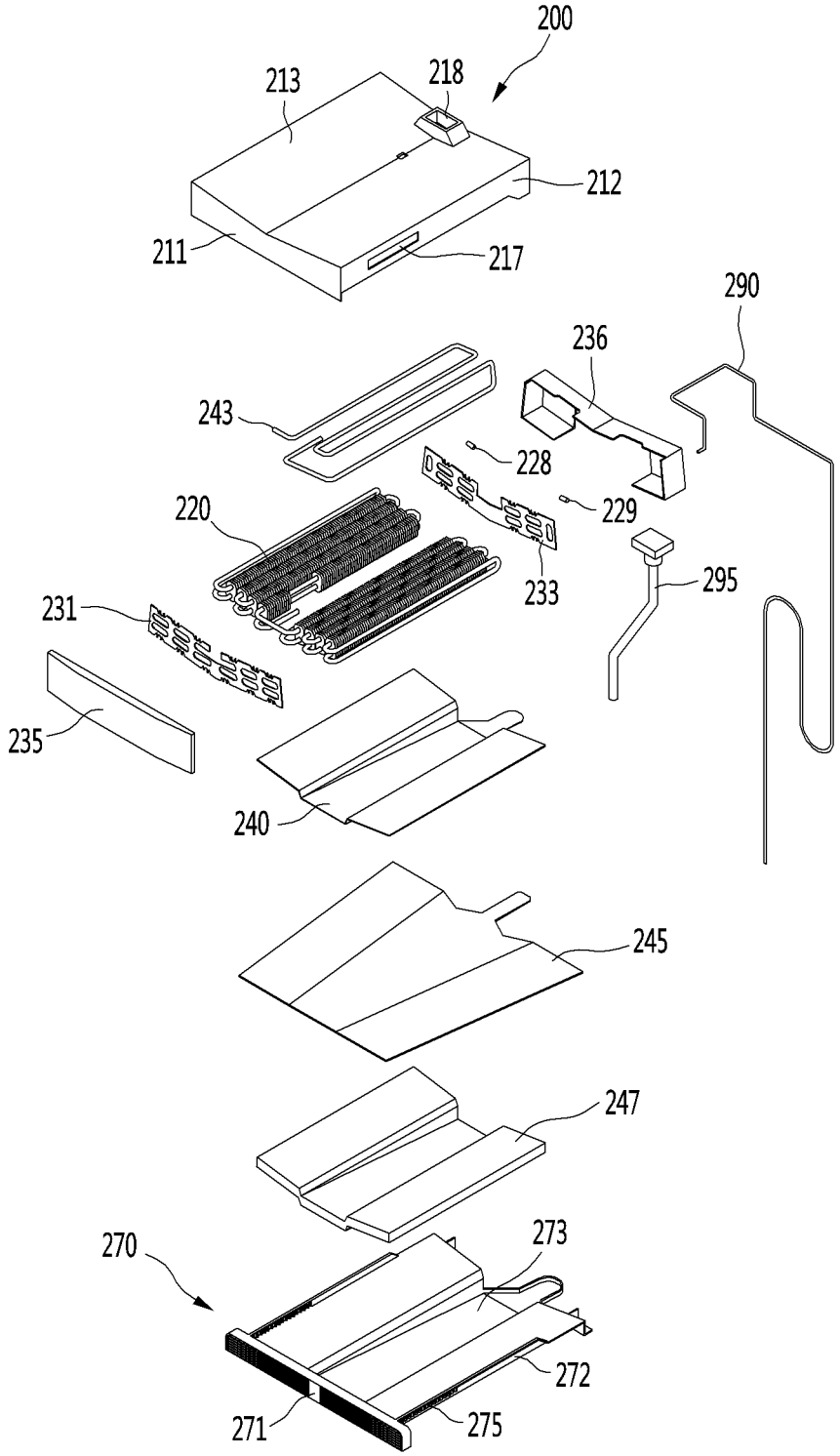
FIG. 6 is an exploded perspective view illustrating the configuration of the cold air generator.

Referring to FIGS. 4 to 6, the cold air supply 100 according to the embodiment may include a cold air generator 200 configured to generate cold air using evaporation heat of refrigerant circulating in the refrigeration cycle and a flow supply unit or device 300 configured to supply the cold air generated by the cold air generator 200 to the storage chambers. The cold air generator 200 may include an evaporator 220 in which the refrigerant is evaporated, a first cover 210 provided above the evaporator 220, and a second cover 270 provided below the evaporator 220. The first cover 210 may be coupled to an upper portion of the second cover 270, and an inner space defined by the first and second covers 210 and 270 may define an installation space in which the evaporator 220 is installed.

Further, the first and second covers 210 and 270 may be named an "evaporator case" accommodating the evaporator 220, and the installation space may be named an "evaporation chamber" or a "heat exchange chamber". The evaporator cases 210 and 270 may be located on the bottom surface of the partition wall 50. The partition wall 50 may insulate the refrigerating chamber 12 from the heat exchange chamber.

Figure 11:
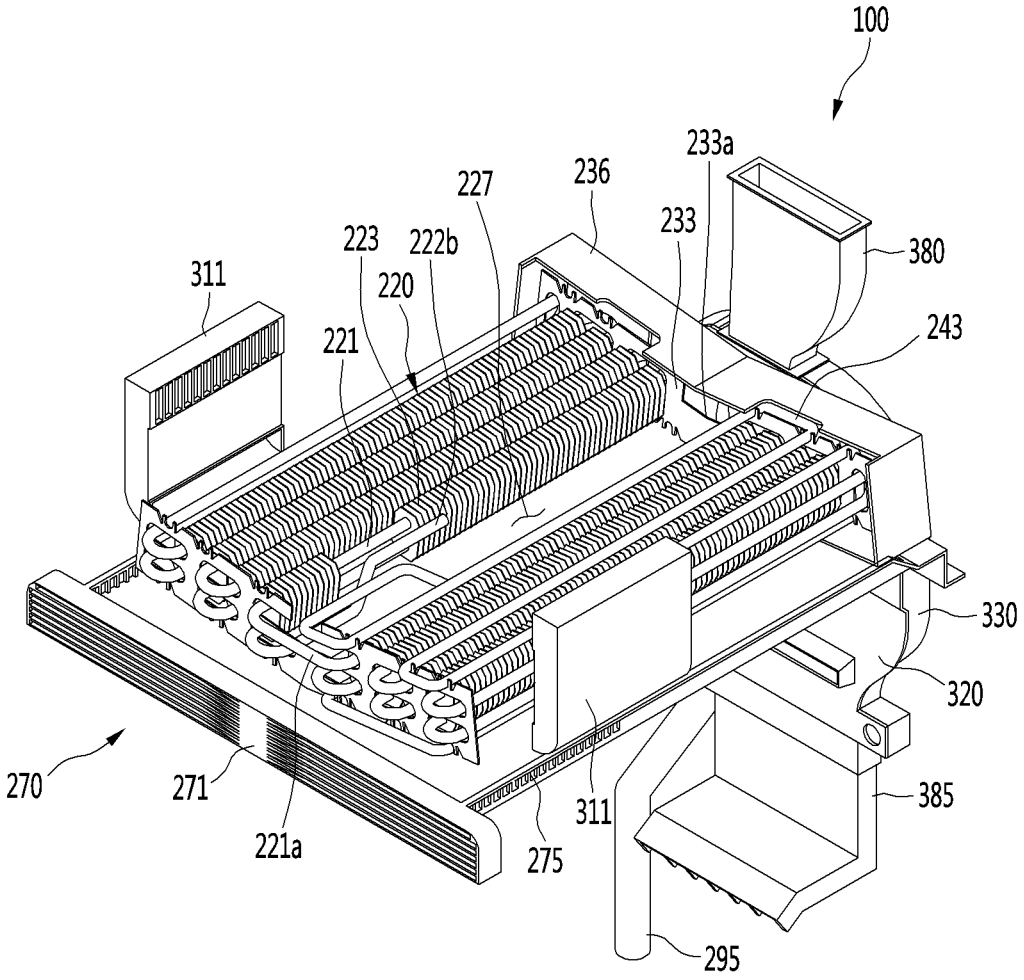
FIG. 11 illustrates a configuration of an interior of the cold air supplying device according to the embodiment.
Figure 12:
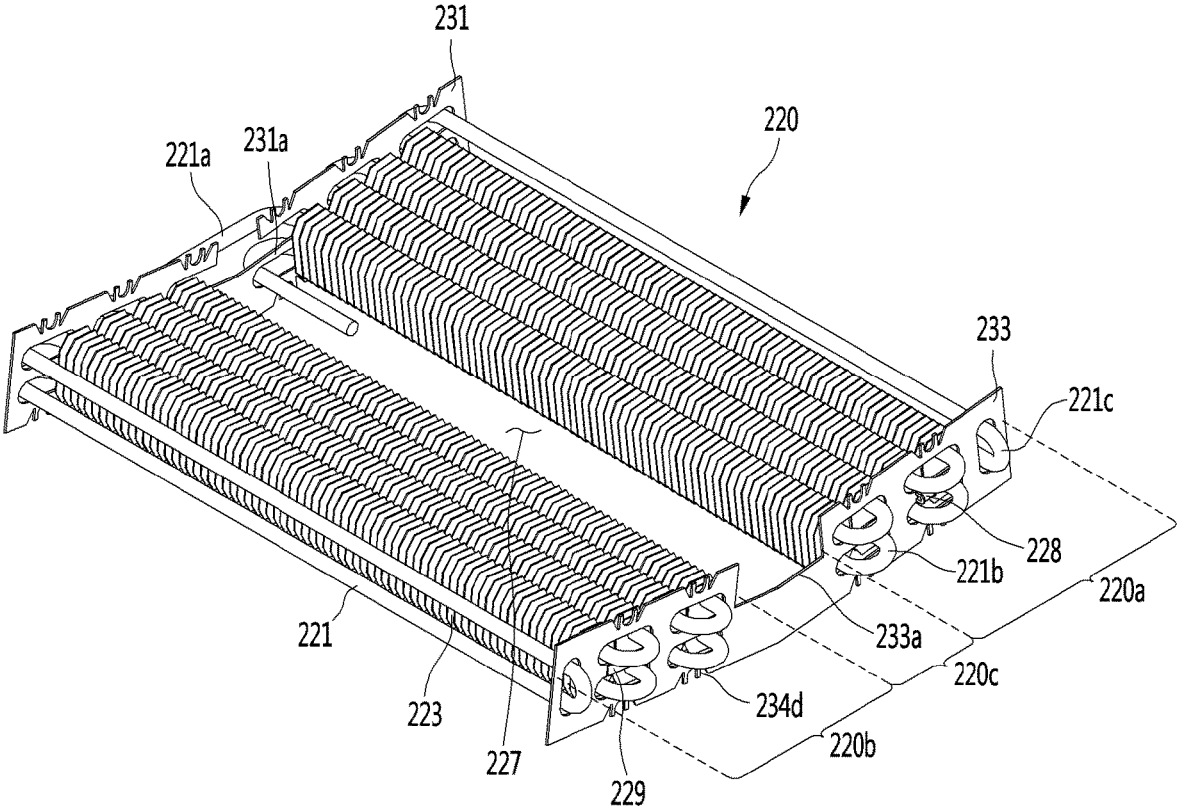
FIG. 12 illustrates a configuration of an evaporator according to the embodiment.
Figure 13:
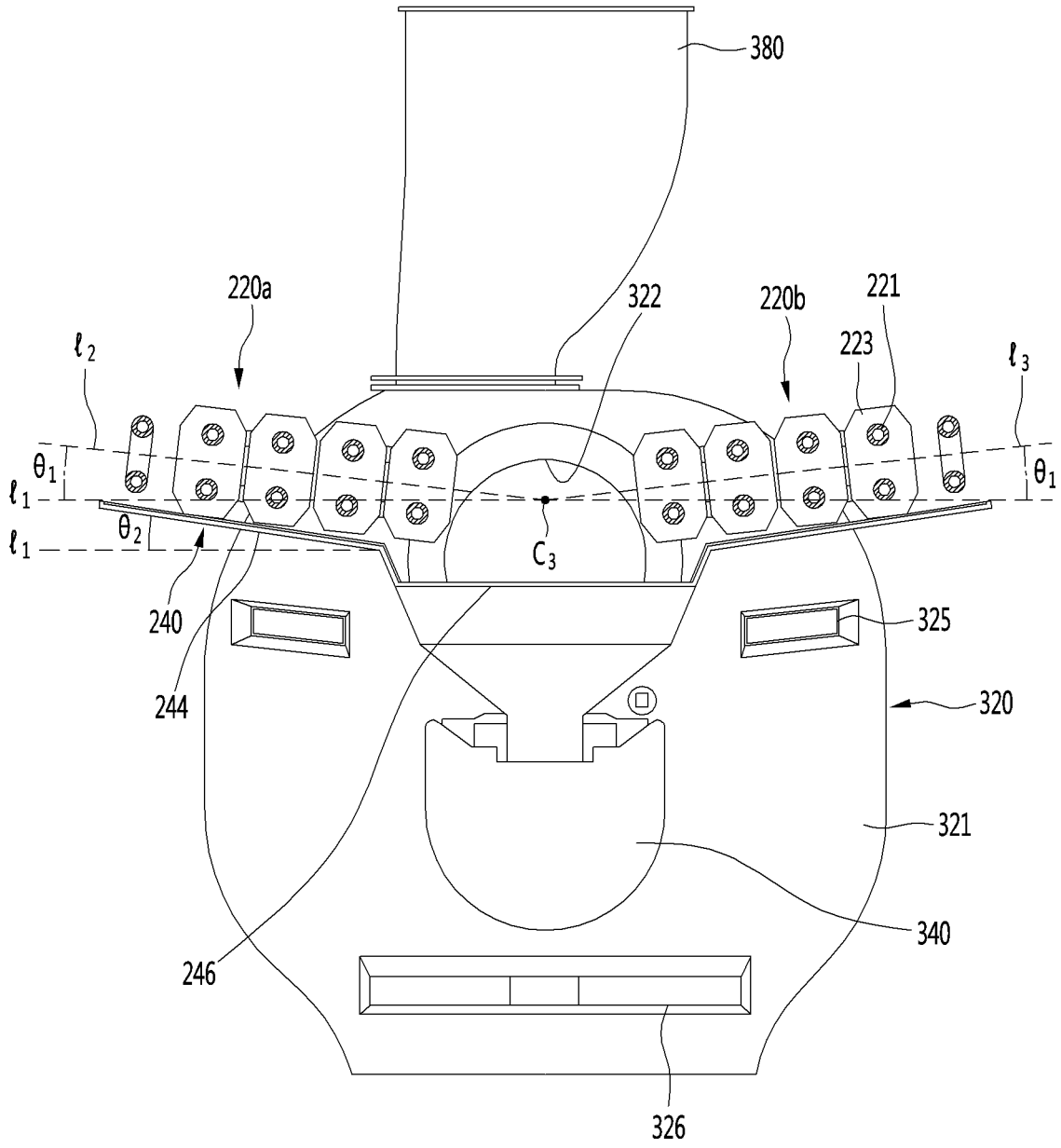
FIG. 13 is a sectional view illustrating configurations of the evaporator and a defrosting water tray according to the embodiment.

The evaporator 220 may include refrigerant pipes 221 through which the refrigerant flows and fins 223 coupled to the refrigerant pipes 221 to increase a heat exchange area for the refrigerant (see FIG. 11). The first cover 210 may form at least a portion of the inner freezing chamber case 75. The first cover 210 may form an inner upper surface of the inner freezing chamber case 75. In other words, the first cover 210 may be formed integrally with the inner freezing chamber case 75 and may be provided on a lower surface of the inner freezing chamber case 75.

The first cover 210 may include a first front cover part (or first front cover) 211 provided in front of the evaporator 220, first side cover parts (or first side covers) 212 extending rearwards from opposite sides of the first front cover part 211, and a first upper cover part (or first upper cover) 213 coupled to upper sides of the opposite first side cover parts 212. A recessed part (or recess) 215 may be formed at a center of the first upper cover 213. The recess 215 may extend from a front side to a rear side of the first upper cover 213.

The first upper cover 213 may be inclined from the recess 215 toward opposite sides of the recess 215. Such a shape may correspond to a shape of the evaporator 220, which may inclined to opposite sides.

Each first side cover 212 may include a first duct coupling port (or first duct coupler) 217 to which a discharge duct 311 of the flow supply device 300 is coupled, which will be described below. As an example, the first duct coupler 217 may be formed in the opposite first side covers 212, respectively. That is, the first duct coupler 217 may be arranged on opposite side surfaces (a left surface and a right surface) of the first cover 210.

The cold air stored in the refrigerating chamber 12 may be discharged through the discharge ducts 311, and the discharged cold air may flow to the inner space defined by the first cover 210 and the second cover 270 via the first duct couplers 217. Further, the cold air may be cooled while passing through the evaporator 220.

The first cover 210 may include a second duct coupling port (or second duct coupler) 218 to which a first supply duct 380 of the flow supply device 300 is coupled. At least a portion of the cold air generated by the evaporator 220 may flow to the first supply duct 380 and may be supplied to the refrigerating chamber 12. The second duct coupler 218 may be provided in the first upper cover 213.

A pipe penetration part or hole 216 through which a suction pipe 290 passes may be formed in the first cover 210. The suction pipe 290, which is a pipe configured to guide the refrigerant evaporated by the evaporator 220 to the compressor, may be connected to the evaporator 220, pass through the pipe penetration hole 216, and extend to the compressor arranged in the machine room 80. The pipe penetration hole 216 may be formed in the recess 215.

The second cover 270, which supports the evaporator 220, may be arranged in the freezing chamber 13. As an example, the second cover 270 may be arranged on a lower side of the inner freezing chamber case 75.

The second cover 270 may include a cover seating part (or cover seat) 273 arranged on a lower side of the evaporator 720 to support the evaporator 220 or a defrosting water tray 240. The cover seat 273 may be from opposite sides toward a central side, to correspond to the inclined shape of the evaporator 220 and the inclined shape of the defrosting water tray 240.

The second cover 270 may further include a second front cover part (or second front cover) 271 provided in front of the cover seat 273. Through-holes 271*a* (see FIG. 9) through which the cold air stored in the freezing chamber 13 may pass may be formed in the second front cover 271. As an example, the through-holes 271*a* may be formed on opposite sides of the second front cover 271 to guide the cold air located on a front side of the freezing chamber 13 such that the cold air may easily flow to cover discharge holes 275. By the formation of the through-holes 271*a*, a flow resistance of the cold air flowing toward the cover discharge holes 275 may be reduced.

Figure 15:
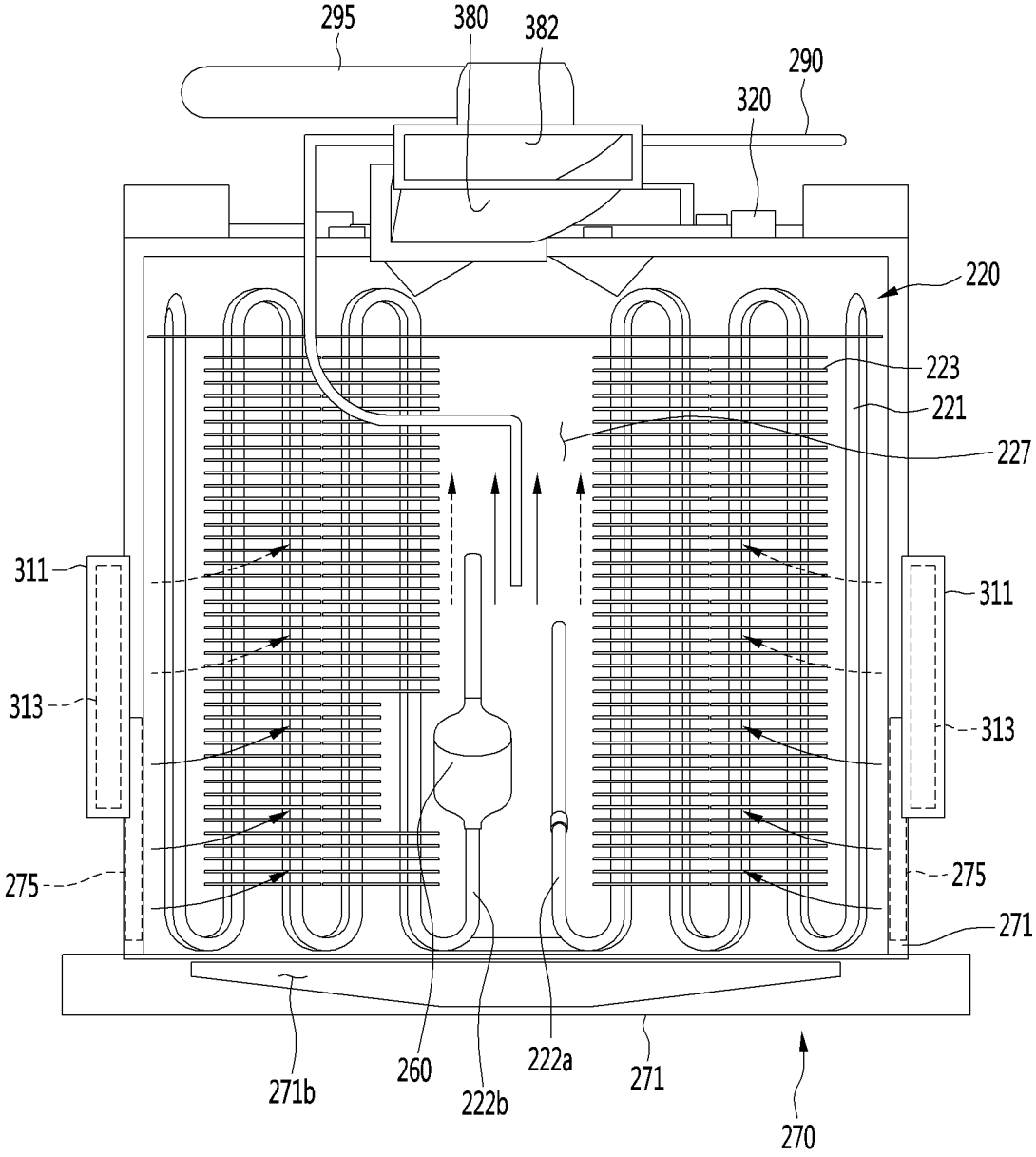
FIG. 15 illustrates flow of cold air passing through the evaporator according to the embodiment.
Figure 16:
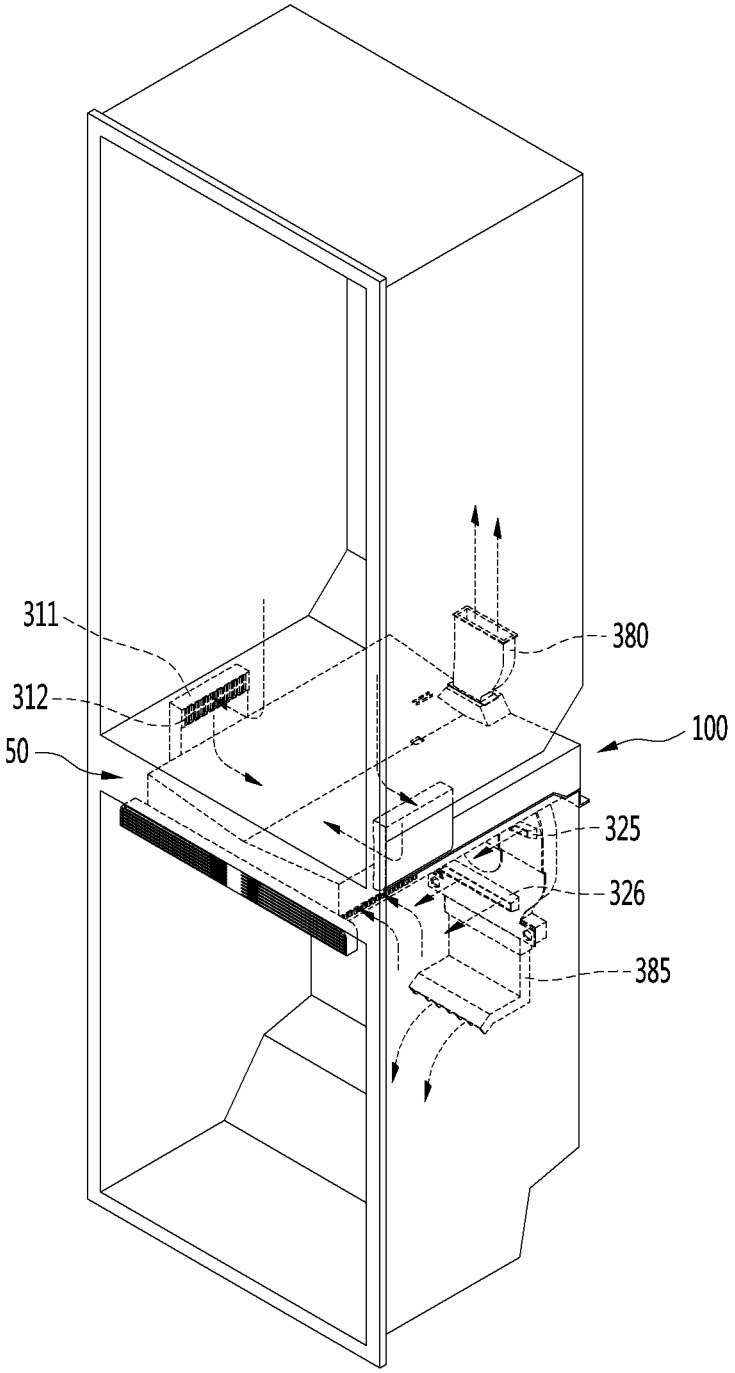
FIGS. 16 and 17 illustrates a state in which the cold air cooled by the evaporator is supplied to storage chambers according to the embodiment.
Figure 17:
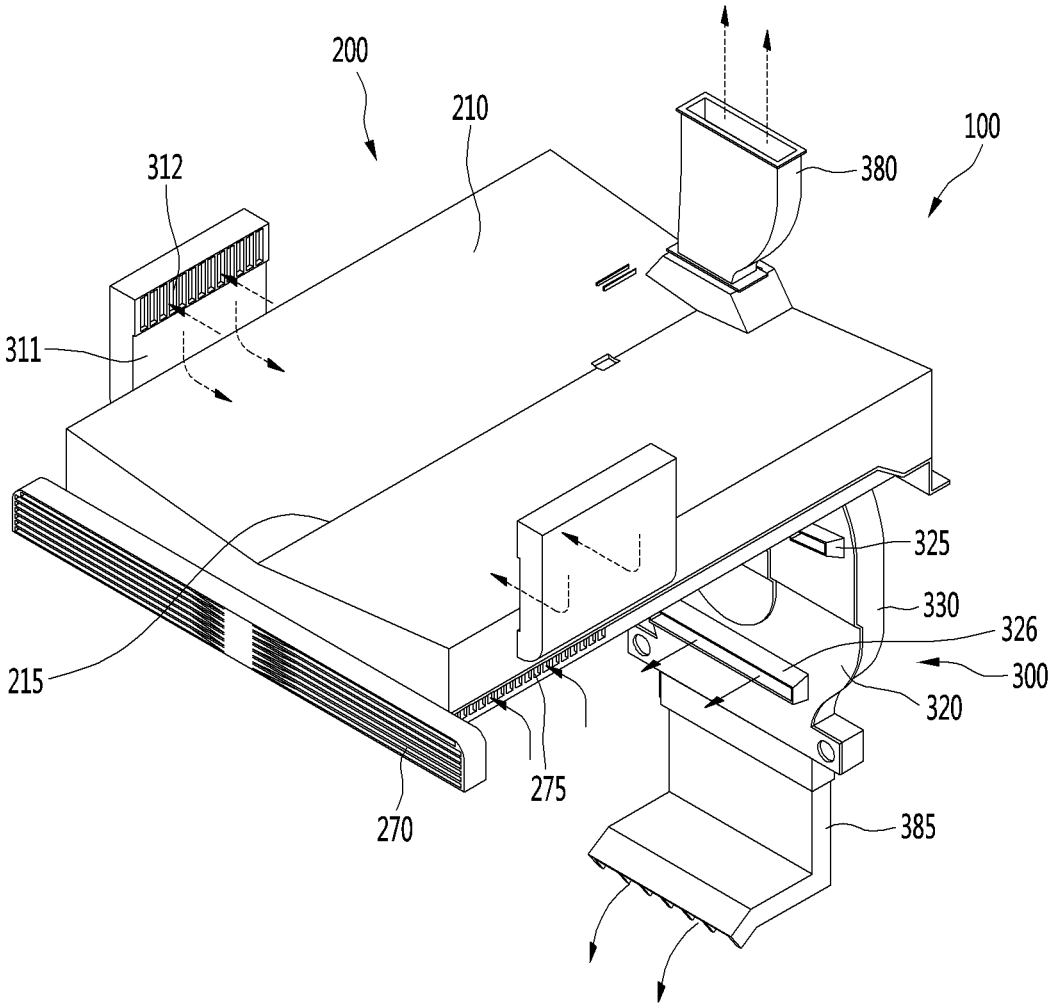

The second cover 270 may further include an insulator inserting part or slot 271*b* in which a cover insulator 235 may be installed. The insulator inserting slot 271 may be formed as an upper surface of the second front cover 271 is penetrated (see FIG. 15).

The second cover 270 may further include second side cover parts 9 or second side cover) 272 coupled to opposite sides of the second front cover 271 to extend toward a rear of the refrigerator. Further, the opposite second side covers 272 may be coupled to opposite sides of the cover seat 273 to extend upwards. The first cover 210 may be coupled to upper portions of the second side covers 272.

The cover discharge holes 275 configured to guide the cold air stored in the freezing chamber 13 to the evaporator 220 may be formed in the second side covers 272. As an example, a plurality of holes may be included in the cover discharge holes 275, and the plurality of holes may be arranged from front or first sides toward rear or second sides of the second side covers 272. The cold air in the freezing chamber 13 may flow to the inner space defined by the first and second covers 210 and 270 through the cover discharge holes 275 and may be cooled while passing through the evaporator 220. The first duct couplers 217 and the cover discharge holes 275 may be collectively named "introduction guide parts".

The cover discharge holes 275 may be arranged on side surfaces of the second storage chamber 13. The cover discharge holes 275 may be arranged at upper portions of opposite sides of the freezing chamber 13. The cold air discharged from the freezing chamber 13 may be introduced into opposite sides of the heat exchange chamber through the cover discharge holes 275 and may be guided by the fins 223 arranged transversely or in a left-right direction so that heat exchange may be effectively performed.

The cold air generator 200 may further include a first heater 243 coupled to the evaporator 220 to supply a predetermined amount of heat to the evaporator 220. The first heater 243, which may be a heater configured to provide an amount of heat for melting ice when frost is generated in the evaporator 220, may be named a "first defrosting heater". As an example, the first heater 243 may be coupled to an upper portion of the evaporator 220.

The cold air generator 200 may further include evaporator supporting devices or support 231, 233 and 236 configured to support the evaporator 220. The evaporator supports 231, 233 and 236 may be located inside the evaporator cases 210 and 270. Further, the evaporator supports 231, 233 and 236 may include evaporator holders 231 and 233 and a supporter 236.

The evaporator holders 231 and 233 may include a first holder 231 supporting a front portion of the evaporator 220 and a second holder 233 supporting a rear portion of the evaporator 220. The first holder 231 may be supported on the defrosting water tray 240 and the second holder 233 may be supported on the supporter 236.

The supporter 236 may be supported on the second cover 270 and may be arranged on a rear side of the evaporator 220. By the configurations of the evaporator holders 231 and 233 and the supporter 236, the evaporator 220 may be stably supported inside the space defined by the first and second covers 210 and 270.

The cold air generator 200 may further include a defrosting sensor 228 configured to detect the temperature near the evaporator 220 to determine a defrosting start time or a defrosting termination time of the evaporator 220. The defrosting sensor 228 may be installed in the evaporator holders 231 and 233, for example, the second holder 233.

The cold air generator 200 may further include a fuse 229 configured to interrupts current applied to the first heater 243. When the temperature of the evaporator 220 is not less than a predetermined temperature, the current supplied to the first heater 243 may be interrupted when the fuse 229 is cut, so that a safety accident may be prevented. The fuse 229 may be installed in the evaporator holders 231 and 233, for example, the second holder 233.

The cold air generator 220 may further include evaporator insulators 235 and 247 configured to perform insulation between the heat exchange area formed near the evaporator 220 and a space outside the heat exchange area. The evaporator insulators 235 and 247 may include a cover insulator 235 arranged on a front side of the first holder 231 to insulate a front space of the evaporator 220.

The evaporator insulators 235 and 247 may also include a tray insulator 247 supported by the second cover 270. The tray insulator 247 may be arranged below the defrosting water tray 240 to insulate a lower space of the evaporator 220. The tray insulator 247 may be seated on the cover seat 273 of the second cover 270 and may be positioned below the second heater 245. In particular, the tray insulator 247 may prevent heat generated by the second heater 245 from being applied to the freezing chamber 13.

The cold air generator 220 may further include the defrosting water tray 240 arranged below the evaporator 220 to collect the defrosting water generated by the evaporator 220. The defrosting water tray 240 may be shaped to be recessed from opposite sides toward a central portion of the defrosting water tray 240 to correspond to the shape of the evaporator 220. Thus, the defrosting water generated by the evaporator 220 may be stored in the defrosting water tray 240 and may flow to the central portion of the defrosting water tray 240.

In a spaced distance between the defrosting water tray 240 and the evaporator 220, a distance between the evaporator 220 and the central portion of the defrosting water tray 240 may be larger than distances between the evaporator 220 and the opposite sides of the defrosting water tray 240. In other words, the spaced distance between the defrosting water tray 240 and the evaporator 220 may be gradually increased from opposite sides toward central portions of the evaporator 220 and the defrosting water tray 240. According to such a configuration, even when an amount of the defrosting water flowing to the central portion of the defrosting water tray 240 is increased, the defrosting water does not contact the surface of the evaporator 220, so that the frost in the evaporator 220 may be prevented.

The cold air generator 200 may further include a second heater 245 arranged below the defrosting water tray 240 to supply a predetermined amount of heat to the defrosting water tray 240. The second heater 245, which may provide an amount of heat to melt ice when frost is generated in the defrosting water tray 240, may be named a "second defrosting heater". The second heater 245 may be arranged between the defrosting water tray 240 and the tray insulator 247.

As an example, the second heater 245 may include a surface-shaped heater having a shape of a plate or a panel. The second heater 245 may be provided on the bottom surface of the defrosting water tray 240, and thus the defrosting water flowing on the upper surface of the defrosting water tray 240 may not be disturbed by the second heater, so that the defrosting water may be easily discharged. Further, the defrosting water may not be applied to the surface of the second heater 245, so that a phenomenon in which the second heater 245 is corroded or malfunctioned by the defrosting water may be prevented.

The cold air generator 200 may further include a drain pipe 295 configured to discharge the defrosting water collected in the defrosting water tray 240 from the defrosting water tray 240. The drain pipe 295 may be arranged on a rear side of grill covers 320 and 330, which will be described below. Further, the drain pipe 295 may be connected to a rear side of the defrosting water tray 240, extend downwards, and communicate with the machine room 80. The defrosting water may flow through the drain pipe 295 to be introduced into the machine room 80, and may be collected in a drain fan provided in the machine room 80.

Figure 7:
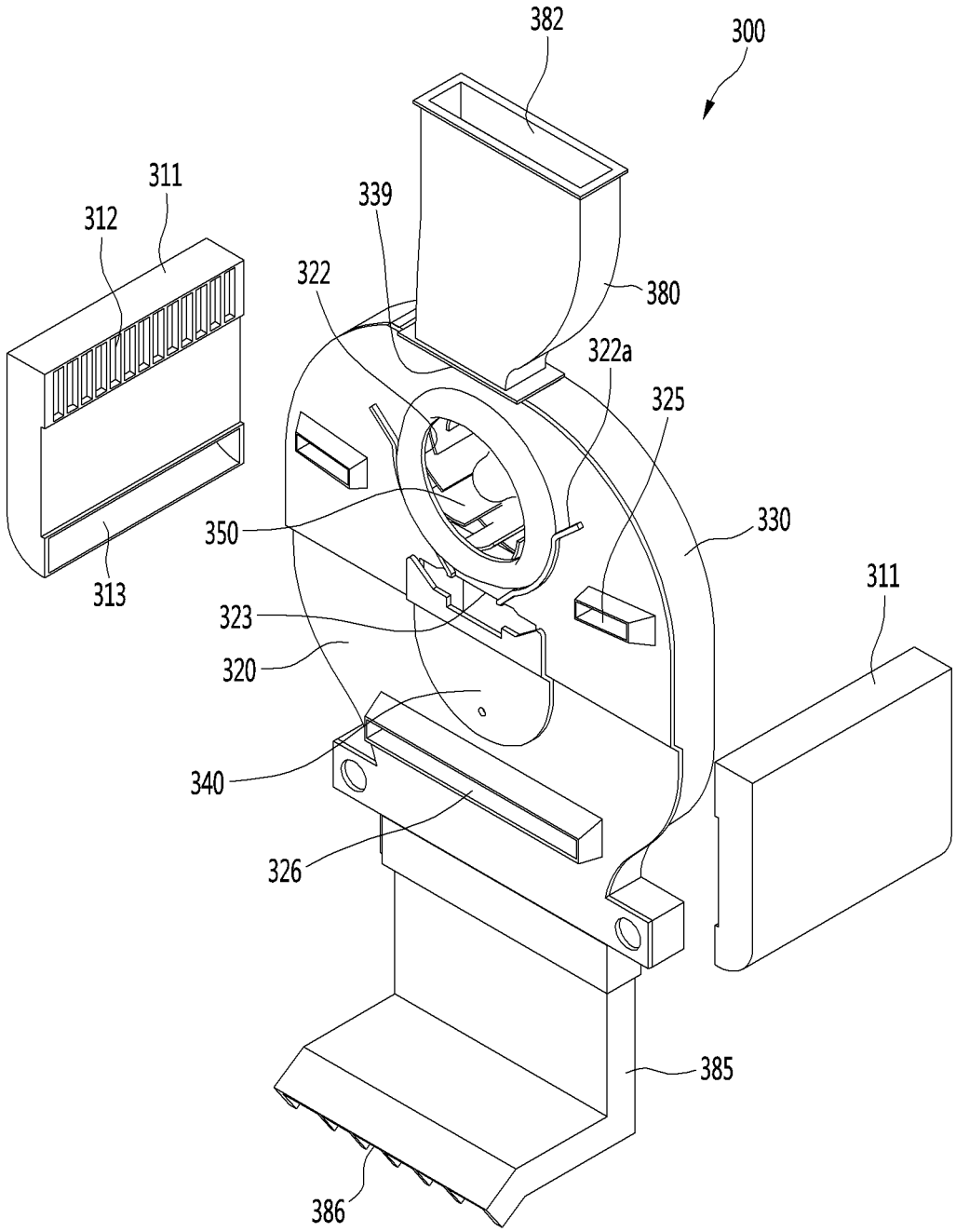
FIG. 7 illustrates a configuration of a flow supply device in the cold air supplying device according to the embodiment.
Figure 8:
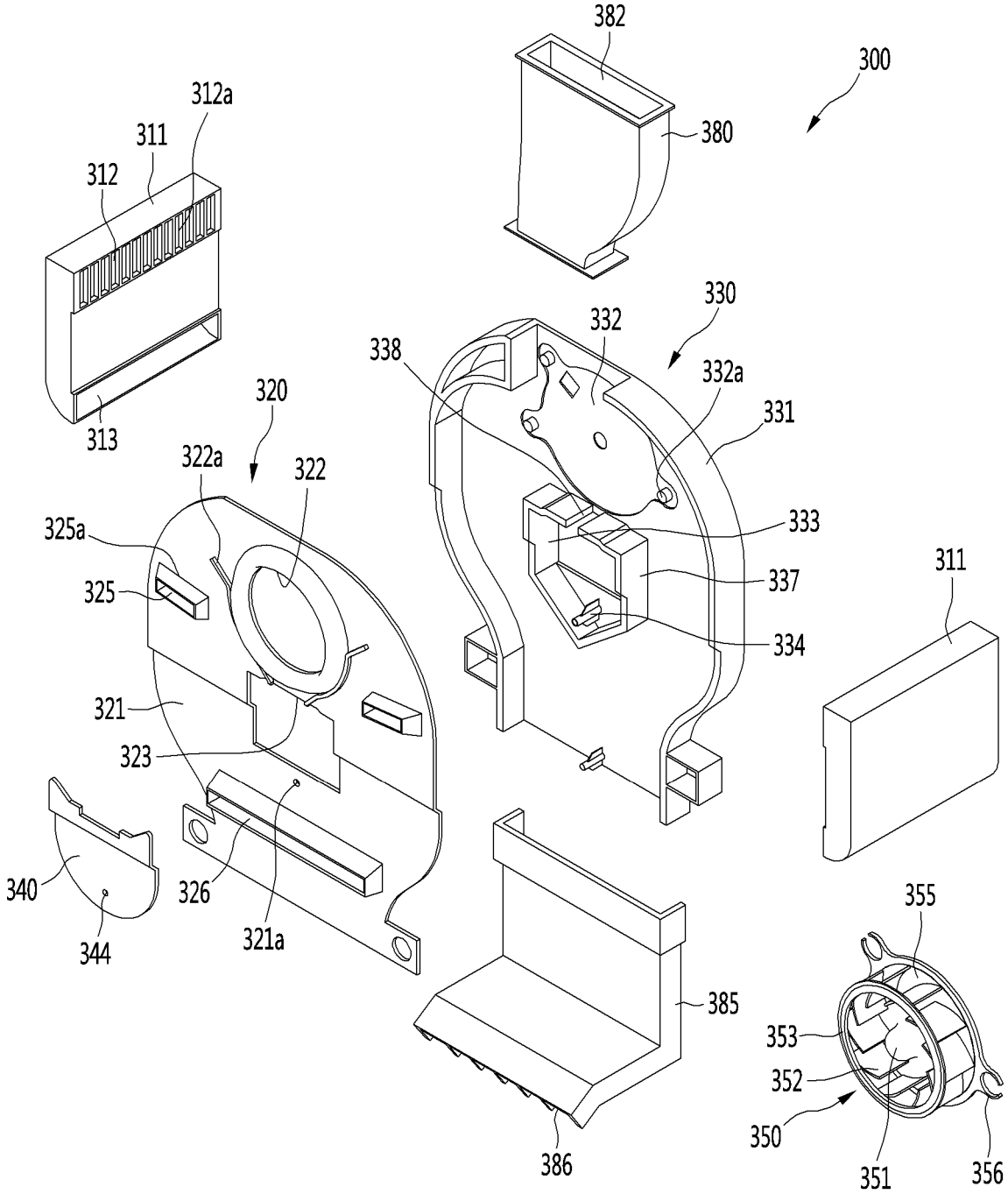
FIG. 8 is an exploded perspective view illustrating the configuration of the flow supply device.

Referring to FIGS. 7 and 8, the flow supply device 300 according to the embodiment may include fan assemblies 350 and 355 configured to generate flow of the cold air. The fan assemblies 350 and 355 may include a blowing fan 350. As an example, the blowing fan 350 may include a centrifugal fan by which the cold air is introduced in an axial direction and is discharged in a circumferential direction. The cold air flowing through a refrigerating chamber suction passage and the cold air flowing through a freezing chamber suction passage may be combined with each other and the combined cold air may be introduced into the blowing fan 350.

The blowing fan 350 may include a hub 351 to which a fan motor is coupled, a plurality of blades arranged on an outer peripheral surface of the hub 351, and a bell mouth 353 coupled to front ends of the plurality of blades 352 to guide the cold air such that the cold air is introduced into the blowing fan 350. The blowing fan 350 may be installed in an inner space between the grill covers 320 and 330. The blowing fan 350 may be seated on a fan seating part (or fan seat) 332 provided in the grill covers 320 and 330. The fan seat 332 may be provided in the second grill cover 330.

The fan assemblies 350 and 355 may further include a fan support 355 coupled to the blowing fan 350 to allow the blowing fan 350 to be supported on the grill covers 320 and 330. The fan support 355 may include cover supports 356 coupled to support coupling parts (or support couplers) 332*a* of the fan seat 332. The plurality of cover supports 356 may be formed along a circumference of the fan support 355.

The flow supply device 300 may further include the grill covers 320 and 330 defining an installation space (hereinafter, referred to as a fan installing space) in which the fan assemblies 350 and 355 are installed. The grill covers 320 and 330 may be located on a rear side of the freezing chamber 13, that is, on a rear surface of the inner freezing chamber case 75.

The grill covers 320 and 330 may include a first grill cover 320 and a second grill cover 330 coupled to a rear side of the first grill cover 320. The installation space may be defined as an inner space defined by coupling the first and second grill covers 320 and 330 to each other.

The first grill cover 320 may include a first grill cover body 321 having a shape of a plate and a fan suction part or port 322 formed in the first grill cover body 321 to guide the cold air heat-exchanged by the evaporator 220 such that the cold air flows to the blowing fan 350. As an example, the fan suction port 322 may be formed at an upper portion of the first grill cover body 321 and may have an approximately circular shape. The air passing through the evaporator 220 may be introduced into the fan installing space via the fan suction port 322.

A condensed water guide 322*a* configured to guide the condensed water generated around the fan suction part 322, that is, the condensed water generated in the grill covers 320 and 330 or the blowing fan 350 to a lower side is provided outside the fan suction port 322. The condensed water guide 322*a* may be provided on a front surface of the first gill cover body 321. As an example, the condensed water guide 322*a* may extend downward along opposite sides of the fan suction port 322. Further, a lower end of the condensed water guide 322*a* may be connected to a first cover inserting part or hole 323.

The first grill cover body 321 may further include the first cover inserting hole 323 into which the second cover 270 or the defrosting water tray 240 of the cold air generator 200 is inserted. Further, the second grill cover body 330 may include a second cover inserting part or hole 333 into which the second cover 270 or the defrosting water tray 240 of the cold air generator 200 is inserted.

The second cover 270 or the defrosting water tray 240 may extend to the inner space between the grill covers 320 and 330 through the first cover inserting hole 323 and extend to a rear side of the grill covers 320 and 330 through the second cover inserting hole 333. Further, the second cover 270 or the defrosting water tray 240 may be connected to the drain pipe 295 and the defrosting water stored in the defrosting water tray 240 may be introduced into the drain pipe 295 (see FIG. 18).

The flow supply device 300 may further include a sub-cover 340 configured to shield at least a portion of the first cover inserting part 323. As an example, the sub-cover 340 may shield a lower space of the first cover inserting hole 323 and the second cover 270 or the defrosting water tray 240 may be inserted into an upper space of the first cover inserting hole 323. In a simple description of an assembling process, after the second cover 270 and the defrosting water tray 240 are inserted into the first cover inserting hole 323, the sub-cover 340 may be assembled with the first cover inserting hole 323.

A coupling hole 344 may be formed in the sub-cover 340. The coupling hole 344 may be coupled to a sub-cover coupling part or boss 334 of the second grill cover 330 by a specific fastening member. In this case, the fastening member may be coupled to the sub-cover coupling boss 334 by passing through a first fastening hole 321*a* of the first grill cover 320. The first fastening hole 321*a* may be located below the first cover inserting part 323.

The first grill cover 320 may include a plurality of cold air supplying parts or ports 325 and 326 configured to discharge the cold air passing through the blowing fan 350 to the freezing chamber 13. The plurality of cold air supplying ports 325 and 326 include first supply parts or ports 325 formed at upper portions of the first grill cover body 321. The plurality of first supply ports 325 may be arranged on opposite sides of the fan suction port 322, and may be located above the first cover inserting hole 323. The first supply ports 325 may supply the cold air toward an upper space of the freezing chamber 13.

As an example, the first supply ports 325 may supply the cold air toward the lower surface of the cold air generator 200, that is, the bottom surface of the second cover 270. Dew may be generated on an outer surface of the second cover 270 due to a difference between the internal temperature of the second cover 270 and the internal temperature of the freezing chamber 13. A larger amount of dew may be generated when the freezing chamber door 22 is opened, and thus humid and hot air may be introduced into the freezing chamber 13.

The cold air supplied through the first supply ports 325 flows toward the second cover 270, so that the dew may be evaporated or the frost existing in the second cover 270 may be removed. To achieve this, the first supply ports 325 may be arranged at locations lower than the bottom surface of the second cover 270. Further, each first supply port 325 may include a supply guide 325*a* arranged to protrude forwards from the first grill cover body 321 to be inclined.

The plurality of cold air supplying ports 325 and 326 may further include a second supply part or port 326 formed at a lower portion of the first grill cover body 321. The second supply port 326 may be located below the first cover inserting hole 323 and may supply the cold air toward a central space or a lower space of the freezing chamber 13.

The second grill cover 330 may be coupled to a rear side of the first grill cover 320. The second grill cover 330 may include a second grill cover body 331 having a shape of a plate. The second grill cover body 331 may include the fan seat 332 having the support couplers 332*a* coupled to the fan supports 355. The fan seat 322 may be provided at an upper portion of the second grill cover 330, and may be arranged at a location corresponding to the fan suction port 322 of the first grill cover 320.

The second grill cover 330 may further include a protrusion 337 protruding forwards from the second grill cover body 331. The protrusion 337 may support a rear surface of the first grill cover 320 and surround the second cover inserting hole 333.

An upper surface of the protrusion 337 may function as a water collector that collects the condensed water generated inside the blowing fan 350 or the grill covers 320 and 330. Further, a condensed water hole 338 through which the condensed water generated by the blowing fan 350 is discharged to a lower side may be formed on the upper surface of the protrusion 337. While the cold air flows through the blowing fan 350, the condensed water may be generated around the fan assemblies 350 and 355. Further, the condensed water may be collected to the upper surface of the protrusion 337 and may fall down to the defrosting water tray 240 through the condensed water hole 338.

The condensed water hole 338 may be located on an upper side of the second cover inserting hole 333 and the defrosting water tray 240 may pass through the second cover inserting hole 333, so that the defrosting water falling down through the condensed water hole 338 may be collected in the defrosting water tray 240. According to such a configuration, the condensed water generated by the fan assemblies 350 and 355 may be easily discharged.

The flow supply device 300 may further include discharge ducts 311 coupled to the evaporator cases 210 and 270 to guide the cold air stored in the refrigerating chamber 12 to insides of the evaporator cases 210 and 270, that is, toward the evaporator 220. The discharge ducts 311 may be coupled to the inner refrigerating chamber case 71 to extend downward, and may be coupled to the evaporator cases 210 and 270.

Discharge holes 312 which communicate with the refrigerating chamber 12 and into which the cold air in the refrigerating chamber 12 is introduced may be formed at upper portions of the discharge ducts 311. A plurality of first grills 312*a* may be provided in the discharge holes 312 to prevent foreign substances existing in the refrigerating chamber 12 from being introduced into the discharge ducts 311 through the discharge holes 312. The discharge holes 312 may be spaces formed between the plurality of first grills 312*a*.

The discharge holes 312 may be formed on side surfaces of the refrigerating chamber 12. The discharge holes 312 may be arranged on side walls of the inner refrigerating chamber case 71. As an example, the discharge holes 312 may be arranged below the side walls of the inner refrigerating chamber case 71.

According to such a configuration, the cold air discharged from the refrigerating chamber 12 may flow to the heat exchange chamber by a relatively short distance, so that heat loss caused by flow loss or an increase in the temperature may be reduced. The discharge holes 312 and the cover discharge holes 275, which are configured to introduce the cold air into the heat exchange chamber, may be named a "first inlet" and a "second inlet" for "second storage chamber inlet"), respectively.

The discharge holes may be located on a lower surface of the lower surface of the inner refrigerating chamber case 71. The cold air in the refrigerating chamber 12, which is discharged through the discharge holes, may flow downward to be introduced into the heat exchange chamber.

As yet another example, the discharge holes may be located inside the refrigerating chamber 12. To achieve this, the discharge ducts may pass through the side walls of the inner refrigerating chamber case 71 to protrude toward the refrigerating chamber 12 by a predetermined length, and the discharge holes may be formed on upper surfaces or side surfaces of the discharge ducts. The predetermined length may not be large. Thus, according to such a configuration, the discharge holes may be arranged at locations that are adjacent to the side walls of the inner refrigerating chamber case 71.

Evaporator supply parts or ports 313 coupled to the evaporator cases 210 and 270 to introduce the cold air discharged from the refrigerating chamber 12 into the installation space for the evaporator 220 may be formed at lower portions of the discharge ducts 311. As an example, the evaporator supply ports 313 may be coupled to the first duct coupling port 217 of the first cover 210.

The discharge ducts 311 may be provided on opposite sides of the evaporator cases 210 and 270. Thus, the cold air stored in the refrigerating chamber 12 may be discharged to opposite sides of the inner refrigerating chamber case 71 and may be supplied to the insides of the evaporator cases 210 and 270 through the discharge ducts 311. Further, the supplied cold air may be cooled while passing through the evaporator 220.

The flow supply device 300 may further include a first supply duct 380 through which at least a portion of the air passing through the blowing fan 350 flows. As an example, the first supply duct 380 may guide a flow of the cold air to be supplied to the refrigerating chamber 12.

The grill covers 320 and 330 may include a refrigerating chamber supply part or port 339 communicating with the first supply duct 380. The refrigerating chamber supply port 339 may be formed by coupling the first grill cover 320 and the second grill cover 330 to each other.

Further, the refrigerating chamber supply port 339 may be coupled to the second duct coupler 218 of the first cover 210. That is, a rear portion of the first cover 210 may be coupled to upper portions of the grill covers 320 and 330 and the second duct coupler 218 and the refrigerating chamber supply port 339 may be vertically aligned to communicate with each other. Thus, the cold air passing through the blowing fan 350 may flow to the first supply duct 380 through the refrigerating chamber supply port 339 of the grill covers 320 and 330 and the second duct coupler 218 of the first cover 210.

A duct connector 382 connected to the refrigerating chamber cold air duct 81 may be formed at an upper portion of the first supply duct 380. Thus, the cold air flowing through the first supply duct 380 may be introduced into the refrigerating chamber cold air duct 81 to flow upwards and may be supplied to the refrigerating chamber 12 through the refrigerating chamber cold air supplying ports 82.

The flow supply device 300 may further include a second supply duct 385 which is coupled to a lower side of the grill covers 320 and 330 and through which at least a portion of the cold air passing through the blowing fan 350 may flow. As an example, the second supply duct 385 may guide a flow of the cold air to be supplied to the freezing chamber 13. Further, a third supply part or port 386 through which the cold air is discharged to the freezing chamber 13 may be formed at a lower portion of the second supply duct 385.

A portion of the cold air passing through the blowing fan 350 may flow upward and may be supplied to the refrigerating chamber 12 through the first supply duct 380. Further, the remaining cold air may flow to opposite sides of the blowing fan 350, and a portion of the remaining cold air may be supplied to an upper space of the freezing chamber 13 through the plurality of first supply ports 325.

The cold air not supplied through the first supply ports 325 may further flow downwards, and may be supplied to a central space of the freezing chamber through the second supply port 326. Further, the cold air not supplied through the second supply port 326 may further flow downwards, may be introduced into the second supply duct 385, and may be supplied to a lower space of the freezing chamber 13 through the third supply port 386.

Figure 9:
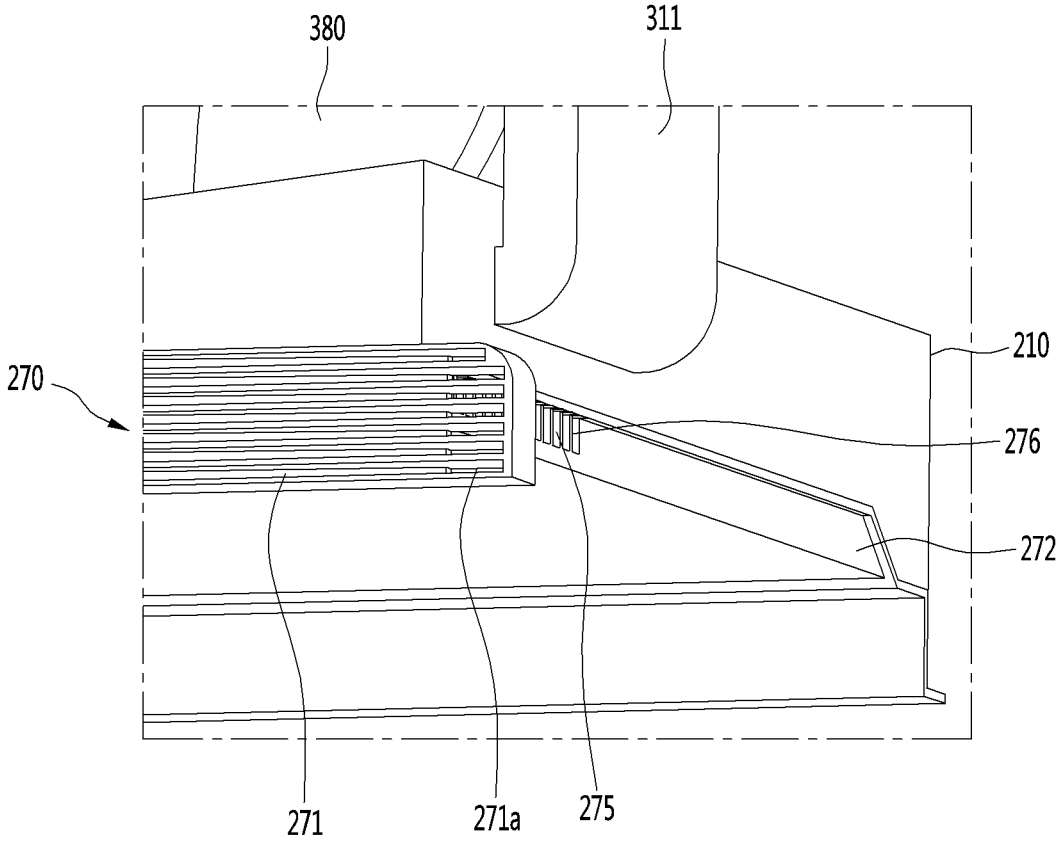
FIG. 9 illustrates configurations of components constituting a cold air suction passage according to the embodiment.
Figure 10:
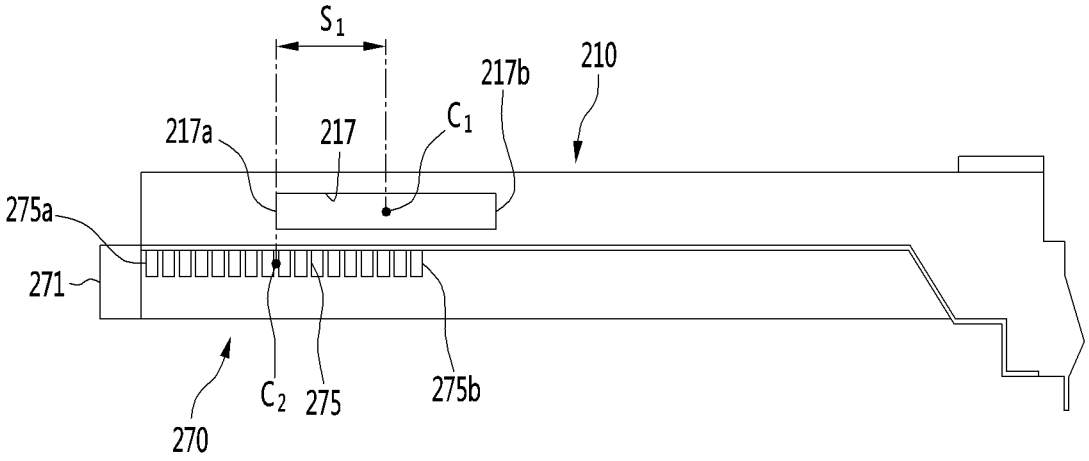
FIG. 10 is a side view illustrating configurations of a first cover and a second cover according to the embodiment.

Referring to FIGS. 9 and 10, a cold air suction passage through which the cold air stored in the storage chambers 12 and 13 is introduced into the installation space for the evaporator 220, that is, the inner space between the evaporator cases 210 and 270, may be formed in the refrigerator 10 according to the embodiment. The cold air suction passage may include a refrigerating chamber suction passage extending from the refrigerating chamber 12 to the installation space for the evaporator 220 and a freezing chamber suction passage extending from the freezing chamber 13 toward the evaporator 220.

The refrigerating chamber suction passage may include the discharge ducts 311 configured to guide the cold air in the refrigerating chamber 12 to the installation space for the evaporator 220. Upper portions of the discharge ducts 311 may be coupled to the inner refrigerating chamber case 71, and lower portions of the discharge ducts 311 may be coupled to the first duct coupling ports 217 provided on left and right surfaces of the evaporator cases 210 and 270. As an example, the first duct coupling ports 217 may be formed at upper portions of the evaporator cases 210 and 270 in the first cover 210.

The freezing chamber suction passage may include the cover discharge holes 275 configured to guide the cold air in the freezing chamber to the installation space for the evaporator 220. The cover discharge holes 275 may be formed on the left and right surfaces of the evaporator cases 210 and 270, or in the opposing second side cover parts 272. As an example, the cover discharge holes 275 may be formed at lower portions of the evaporator cases 270 and 270 in the second cover 270.

A plurality of second grills 276 may be provided in the cover discharge holes 275 to prevent foreign substances existing in the freezing chamber 13 from being introduced into the installation space for the evaporator 220 through the cover discharge holes 275. The cover discharge holes 275 may be spaces formed between the plurality of second grills 276.

The refrigerating chamber suction passage and the freezing chamber suction passage may be vertically arranged. As an example, the refrigerating chamber suction passage may be arranged above the freezing chamber suction passage. The first duct coupling ports 217 of the first cover 210 may also be located above the cover discharge holes 275 of the second cover 270. Further, the evaporator 220 may have the refrigerant pipes 221 vertically arranged in two rows. Thus, the cold air introduced through the first duct coupling ports 217 may flow to the refrigerant pipe 221 located in an upper row among the two-row refrigerant pipes 221, and the cold air introduced through the cover discharge holes 275 may flow to the refrigerant pipe 221 located in a lower row among the two-row refrigerant pipes 221.

In this way, the cold air may be introduced into the installation space for the evaporator 220 in a state in which the heights of the two suction passages are different from each other, so that the cold air introduced through the suction passages may be prevented from interfering with each other. Thus, flow resistance of the cold air introduced through the two suction passages may be reduced.

The first duct coupling ports 217 may be formed by penetrating at least portions of the first side cover parts 212 and may extend in a first direction which may be from a front to a rear of the refrigerator. Each first duct coupling port 217 may include a first front end 217*a* and a first rear end 217*b*. A length of the first duct coupling port may be understood as a distance between the first front end 217*a* and the first rear end 217*b*.

As an example, the first rear end 217*b* may be located at an approximately central portion of the corresponding first side cover 212 with respect to the first direction. Further, a first central point C1 indicating a center between the first front end 217*a* and the first rear end 217*b* may be defined in the first duct coupling port 217.

The cover discharging holes 275 may be formed by penetrating at least portions of the second side covers 272 and extend in the first direction. Each cover discharge hole 275 may include a second front end 275*a* and a second rear end 275*b*. A length of the cover discharge hole 275 may be understood as a distance between the second front end 275*a* and the second rear end 275*b*.

The first duct coupling port 217 and the cover discharge hole 275 may be arranged to intersect each other in the first direction. That is, the cover discharge hole 275 may be located in front of the first duct coupling port 217 with respect to a vertical reference line.

The second front end 275*a* may be located in front of the first front end 217*a*, and the second rear end 275*b* may be located in front of the first rear end 217*b*. Further, a second central point C2 indicating a center between the second front end 275*a* and the second rear end 275*b* may be defined in the cover discharge hole 275. The second central point C2 may be located in front of the first central point C1. A spaced distance between the first central point C1 and the second central point C2 is formed as S1.

According to such a configuration, the cover discharge hole 275 may be located relatively in front of the first duct coupling port 217. Further, the cover discharge hole 275 may be arranged at a location corresponding to the front side of the evaporator 220, and the first duct coupler 17 may be arranged at a location corresponding to the central portion of the evaporator 220. Because the blowing fan 350 is arranged on the rear side of the evaporator 220, the cold air introduced into the evaporator 220 may flow from the front side to the rear side of the evaporator 220.

As a result, the cold air introduced into the installation space for the evaporator 220 through the cover discharge holes 275 may perform heat exchange while flowing from the front side to the rear side of the evaporator 220, so that the heat exchange area is formed to be relatively large. On the other hand, the cold air introduced into the installation space for the evaporator 220 through the first duct coupling ports 217 may perform heat exchange while flowing from an approximately central side to the rear side of the evaporator 220, so that the heat exchange area is relatively small.

Because the temperature of the cold air stored in the freezing chamber 13 is lower than the temperature of the cold air stored in the refrigerating chamber 12, a larger cooling load may be required. Thus, the freezing chamber suction passage may be located in front of the refrigerating chamber suction passage, so that the heat exchange area of the cold air flowing through the freezing chamber suction passage may be larger than the heat exchange area of the cold air flowing through the refrigerating chamber suction passage. According to such a configuration, heat exchange performance of the evaporator 220 may be improved (see FIG. 15).

Because the blowing fan 350 is installed on the rear side of the evaporator 220, and heat exchange is performed while the cold air flowing through the cold air suction passage is introduced from opposite sides of the evaporator 220 and flows to the rear side of the evaporator 220, a flow rate of the refrigerating chamber suction passage that is relatively close to the blowing fan 350 may increase. Thus, the shapes, the sizes, the locations or the like of the blowing fan 350, the discharge ducts 311, the first supply duct 380, the first to third supply ports 325, 326, 386, the first duct coupling ports 217 and the cover discharge holes 275 may be designed such that a flow rate of the cold air passing through the freezing chamber suction passage is larger than a flow rate the cold air passing through the refrigerating chamber suction passage. As an example, a ratio of the flow rate of the cold air of the freezing chamber suction passage to the flow rate of the cold air of the refrigerating chamber suction passage may be about 8:2.

Referring to FIGS. 11 to 14, the cold air supplying device 100 according to the embodiment may include the evaporator 220 installed inside the evaporator cases 210 and 270. The evaporator 220 may include the refrigerant pipes 221 through which the refrigerant flows and the fins 223 coupled to the refrigerant pipes 221. As an example, the refrigerant pipes 221 may be bent several times, may extend transversely, and may be vertically arranged in two rows. According to such a configuration, a flow distance of the refrigerant is increased, so that a heat exchange amount may be increased.

The fins 223 may vertically extend to be coupled to the two-row refrigerant pipes 221, and may guide flow of the cold air to promote heat exchange between the cold air and the refrigerant. According to the refrigerant pipes 221 and the fins 223, heat exchange performance of the refrigerant may be improved.

The cold air supplying device 100 may include an inlet pipe 222*a* connected to inlets of the refrigerant pipes 221 to introduce the refrigerant into the refrigerant pipes 221 and an outlet pipe 222*b* connected to outlets of the refrigerant pipes 221 such that the refrigerant circulating in the refrigerant pipes 221 is discharged through the outlet pipe 222*b*. The inlet pipe 222*a* and the outlet pipe 222*b* may be arranged at a central portion of the evaporator 220.

Further, a gas/liquid separator 260 configured to separate gas refrigerant from the refrigerant passing through the evaporator 220 and supply the separated gas refrigerant to the suction pipe 290 may be installed at an exit of the outlet pipe 222*b*. The gas/liquid separator 260 may be installed in a fan suction passage 227. According to such arrangement of the gas/liquid separator 260, the gas/liquid separator 260 may be arranged at a relatively low position, and accordingly, the vertical height of the cold air supplying device 100 may be reduced (see FIG. 15).

As an example, the refrigerant introduced into the lower-row refrigerant pipe 221 of the evaporator 220 through the inlet pipe 222*a* may flow to a left side (or a right side), flow to the upper-row refrigerant pipe 221, and then flows to the right side (or the left side) toward an opposite portion of the evaporator 220. Further, the refrigerant may be introduced into the low-row refrigerant pipe 221 of the refrigerant pipe 221, may flow toward the central portion of the evaporator 220, and may be discharged through the outlet pipe 222*b*.

The plurality of fins 223 may be provided. The plurality of fins 223 may be spaced apart from each other in the first direction. Further, some fins 223 among the plurality of fins 223 may extend in a transverse or second direction or a left-right direction. The fins 223 constituting such arrangement may be named "guide fins". The guide fins may extend from side parts or portions 220*a* and 220*b* toward a central part or portion 220*c* of the evaporator 220 to guide flow of the cold air at the side parts.

According to such a configuration, when the cold air introduced from the opposite sides of the evaporator 220 flows to the central portion 220*c* of the evaporator 220, the cold air may easily flow along the plurality of fins 223, particularly, the guide fins. That is, a phenomenon in which the fins 223 disturb the flow of the cold air may be prevented. The evaporator 220 may further include the first heater 243 coupled to an upper portion of the refrigerant pipes 221 to provide a predetermined amount of heat to the evaporator 220 at a defrosting time of the evaporator 220 so as to melt ice frosted in the refrigerant pipes 221 or the fins 223.

The evaporator 220 may include the side portions 220*a* and 220*b* defining opposite side portions of the evaporator 220 and the central portion 220*c* defining a central portion of the evaporator 220. The side portions 220*a* and 220*b* may include a plurality of heat exchangers 220*a* and 220*b*. Further, the central portion 220*c* may include the fan suction passage 227 formed between the plurality of heat exchangers 220*a* and 220*b* to define a suction-side passage of the blowing fan 350.

The side portions 220*a* and 220*b* may be adjacent to the discharge ducts 311 or the discharge holes 312. Further, the side portions 220*a* and 220*b* may be adjacent to the cover discharge holes 275. The side portions 220*a* and 220*b* may be adjacent to sides of the first duct coupling ports 217 and the cover discharge holes 275.

The side portions 220*a* and 220*b* may include a first exchanger 220*a* and a second heat exchanger 220*b*. Further, the fan suction passage 227 may be understood as a cold air passage not having the refrigerant pipes 221 and the fins 223. According to such a configuration, the cold air cooled while passing through the first and second heat exchangers 220*a* and 220*b* may be joined to the fan suction passage 227 and may flow toward the blowing fan 350.

The first and second heat exchangers 220*a* and 220*b* may include the refrigerant pipes 221 and the fins 223. The refrigerant pipes 221 may include a connector 221*a* connecting the first and second heat exchangers 220*a* and 220*b* to each other. The connector 221*a* may have a bent shape, for example, a shape of a U-shaped pipe.

The connector 221*a* may be arranged on a front side of the evaporator 220 and may be supported by the first holder 231. The first holder 231 may include a connection support 231*a* supporting the connector 221*a*. The connection support 231*a* may be formed by recessing at least a portion of the first holder 231, and the connector 221*a* may be fitted in the recessed portion.

Figure 14:
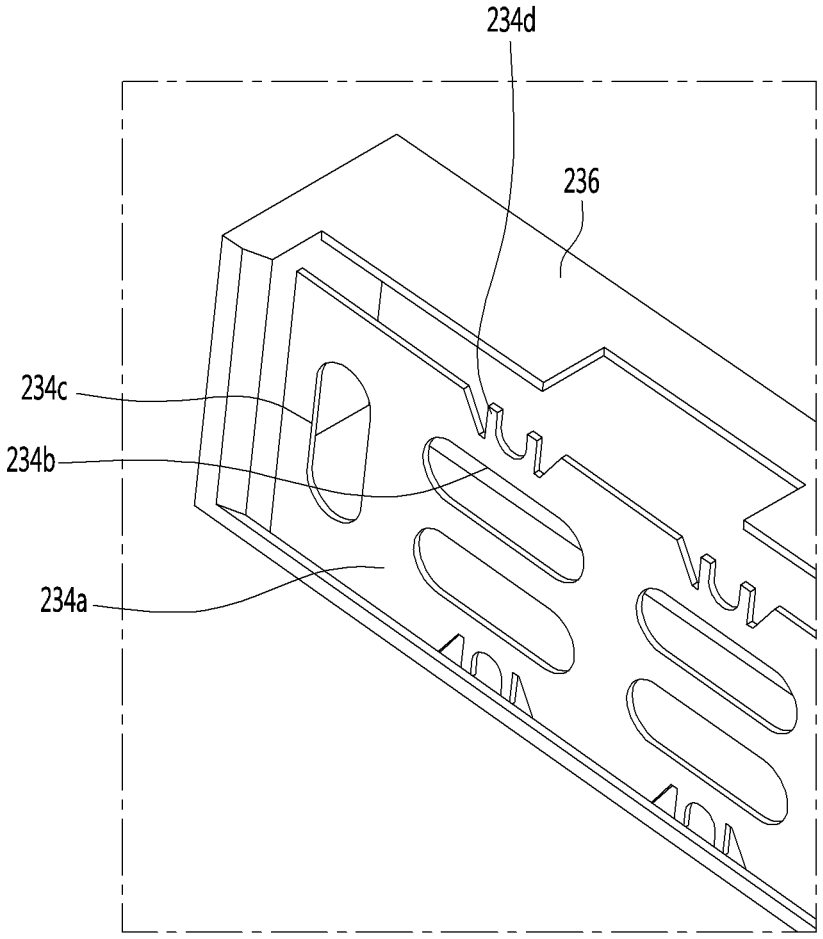
FIG. 14 illustrates configurations of a holder and a supporter that support the evaporator according to the embodiment.

The cold air supplying device 100 may include the first holder 231 supporting a front portion of the evaporator 220 and the second holder 233 supporting a rear portion of the evaporator 220. The first holder 231 or the second holder 233 may include through-holes 234*b* and 234*c* on which the refrigerant pipes 221 are supported. Referring to FIG. 14, the second holder 233 may include a holder body 234*a* having a shape of a plate and extending in the second direction and the plurality of through-holes 234*b* and 234*c* formed by penetrating at least portions of the holder body 234*a*.

The plurality of through-holes 234*b* and 234*c* may include a plurality of first through-holes 234*b* into which first bent pipes 221*b* of the refrigerant pipes 221 are inserted and second through-holes 234*c* into which second bent pipes 221*c* of the refrigerant pipes 221 are inserted. The plurality of first through-holes 234*b* may be arranged at upper and lower portions of the holder body 234*a* in two rows and may be spaced apart from each other in the second direction.

The first bent pipes 221*b* may be pipes provided at rear portions of the refrigerant pipes 221 to switch a flow direction of the refrigerant flowing through the refrigerant pipes 221 from a forward direction to a rearward direction or from a rearward direction to a forward direction. The first through-holes 234*b* may extend in the second direction.

Further, the second bent pipes 221*c* may be pipes provided at side portions of the refrigerant pipes 221 to switch the flow direction of the refrigerant flowing through the refrigerant pipes 221 from the lower row to the upper row of the refrigerant pipes 221. The second through-holes 234*c* may extend in a third direction, perpendicular to the first and second directions.

The second holder 233 may be coupled to the supporter 236. The supporter 236 may be coupled to the second holder 233 and may be located in front of the fan suction port 322 of the grill covers 320 and 330.

The second holder 233 may further include support bosses 234*d* provided at edges of the holder body 234*a* and supported on an inner surface of the supporter 236. The support bosses 234*d* may be provided on upper and lower sides of the first through holes 234*b* and may reduce a contact area of the supporter 236 and the second holder 233. According to such configurations of the support bosses 234*d*, stress transferred from the supporter 236 via the second holder 233 to the refrigerant pipes 221 may be reduced.

Further, the plurality of support bosses 234*d* are provided, and a support space in which the first heater 243 is located may be formed between the plurality of support bosses 234*d*. According to such a configuration, in a state in which the first heater 243 is supported on the support space, the support bosses 234*d* may be supported on an inner surface of the supporter 236, so that the first heater 243 may be stably fixed.

Although a configuration of the holder has been described based on the second holder 233, the holder body 234*a*, the first through-holes 234*b* and the support bosses 234*d* provided in the second holder 233 may be identically applied to the first holder 231. The second holder 233 may further include a recessed part or recess 233*a* communicating with the fan suction passage 227 and configured to guide the cold air passing through the evaporator 220 such that the cold air flows toward the blowing fan 350.

The recess 233*a* may be formed at an approximately central portion of the holder body 234*a* to be recessed downward from an upper surface of the holder body 234*a*. Further, the recess 233*a* may be arranged on a front side of the fan suction port 322 of the grill covers 320 and 330. The cold air cooled by the evaporator 220 may be introduced into the fan suction port 322 via the fan suction passage 227 and the recess 233*a*.

The first heat exchanger 220*a* and the second heat exchanger 220*b* may extend from the central portion to the lateral sides of the evaporator 220 to intersect each other. In other words, the first heat exchanger 220*a* and the second heat exchanger 220*b* may be upward inclined upward toward the lateral sides with respect to the fan suction passage 227. That is, when a central portion of the fan suction passage 227 is defined as C3, and central lines 12 and 13 passing through vertical centers of the first and second heat exchangers 220*a* and 220*b* are defined, the central portion C3 and the central lines 12 and 13 may have a V shape or a wedge shape.

When a line passing through a vertical lengthwise center of the two-row refrigerant pipes 221 and the fins 223 provided in the first heat exchanger 220*a* and the central portion C3 is the first central line I2, the first central line I2 may extend to be inclined upward from the central portion C2 to a left side. That is, the first central line I2 may have a predetermined first setting angle θ1 with respect to a horizontal line I1. As an example, the first setting angle θ1 may have a range of 5-10°.

When a line passing through a vertical lengthwise center of the two-row refrigerant pipes 221 and the fins 223 provided in the second heat exchanger 220*b* and the central portion C3 is the second central line I3, the second central line I3 may be inclined upward from the central portion C2 to a right side. That is, the second central line 12 may have a predetermined first setting angle θ1 with respect to the horizontal line I1.

According to a configuration of the evaporator 220, a vertical width of the cold air supplying device 100 may be relatively reduced, so that a storage space of the freezing chamber 13 may be relatively increased. The vertical width of the cold air supplying device 100 may not be large, so that the relatively large thickness of the partition wall insulator 55 located in the partition wall 50 may be secured. As a result, there is an advantage in that even while the thickness of the partition wall insulator 55 is relatively increased, the entire thickness of the partition wall 50 and the cold air supplying device 100 may be relatively reduced.

Further, as compared with an evaporator horizontally arranged in a transverse direction, the heat exchange area of the evaporator 220 may be relatively increased, so that heat exchange performance may be improved. According to a configuration in which the evaporator 220 is inclined in a V shape, the first and second holders 231 and 233 supporting a front portion and a rear portion of the evaporator 220 may be also inclined upward from a central portion toward opposite sides thereof.

The defrosting water tray 240 configured to collect the defrosting water generated by the evaporator 220 may be installed on a lower side of the evaporator 220. The defrosting water tray 240 may be spaced downward apart from a lower end of the evaporator 220 to store the defrosting water falling down from the evaporator 220.

A lower surface of the defrosting water tray 240 may extend from a central portion toward a lateral side of the defrosting water tray 240 to be inclined upward with respect to the horizontal line I1. That is, the lower surface of the defrosting water tray 240 may have a predetermined second setting angle θ2 with respect to the horizontal line I1. The second setting angle θ2 may be slightly larger than the first setting angle θ1. As an example, the second setting angle θ2 may have a range of 10-15°.

The defrosting water tray 240 may include flow guides 244 inclined downward from opposite sides toward the central portion of the defrosting water tray 240. That is, the plurality of flow guides 244 may be provided on opposite sides of the defrosting water tray 240.

The downwards inclined shapes of the flow guides 244 correspond to the inclined shape of the evaporator 220, and accordingly, the defrosting water falling down to the defrosting water tray 240 may flow toward the central portion of the defrosting water tray 240 along the flow guides 244. The flow guides 244 may form the second setting angle θ2 with respect to the horizontal line I1.

A distance between the lower end of the evaporator 220 and the flow guides 244 may be gradually increased from the opposite sides to the central portion of the defrosting water tray 240. According to such a configuration, even though an amount of the defrosting water is increased while the defrosting water flows toward the central portion of the defrosting water tray 240 along the flow guides 244, the defrosting water may easily flow without interference from the evaporator 220.

The defrosting water tray 240 may further include a defrosting water storage part or trough 246 downwards recessed from the opposite flow guides 244. The defrosting water storage trough 246 may be formed below the fan suction passage 227.

An angle which is recessed, that is, inclined, from the flow guides 244 to the defrosting water storage trough 246 may be larger than a downwards inclined angle of the flow guides 244. In this way, the defrosting water storage part 246 has a recessed shape, so that a discharge speed of the defrosting water flowing along the opposite flow guides 244 may be increased, and accordingly, the defrosting water may be easily discharged.

The defrosting water tray 240 may be inclined downward from a front portion to a rear portion thereof. The lower portion of the defrosting water tray 240 may extend downward while passing through the cover inserting holes 323 and 333 of the grill cover 320 and 330 and may be connected to the drain pipe 295. According to such a configuration, the defrosting water stored in the defrosting water storage part 246 may flow from the front portion to the rear portion of the defrosting water tray 240 and may be easily discharged to the drain pipe 295.

Referring to FIGS. 15 to 18, to increase the volumes of the storage chambers 12 and 13 of the refrigerator, the installation space for the evaporator, that is, the heat exchange chamber, may be formed on a rear side of the related storage chambers. However, the installation space may be moved to the partition wall 50 between the first storage chamber 12 and the second storage chamber 13. That is, the cold air generator 200 having the heat exchange chamber may be located in the partition wall 50 or on one side of the partition wall 50.

Figure 18:
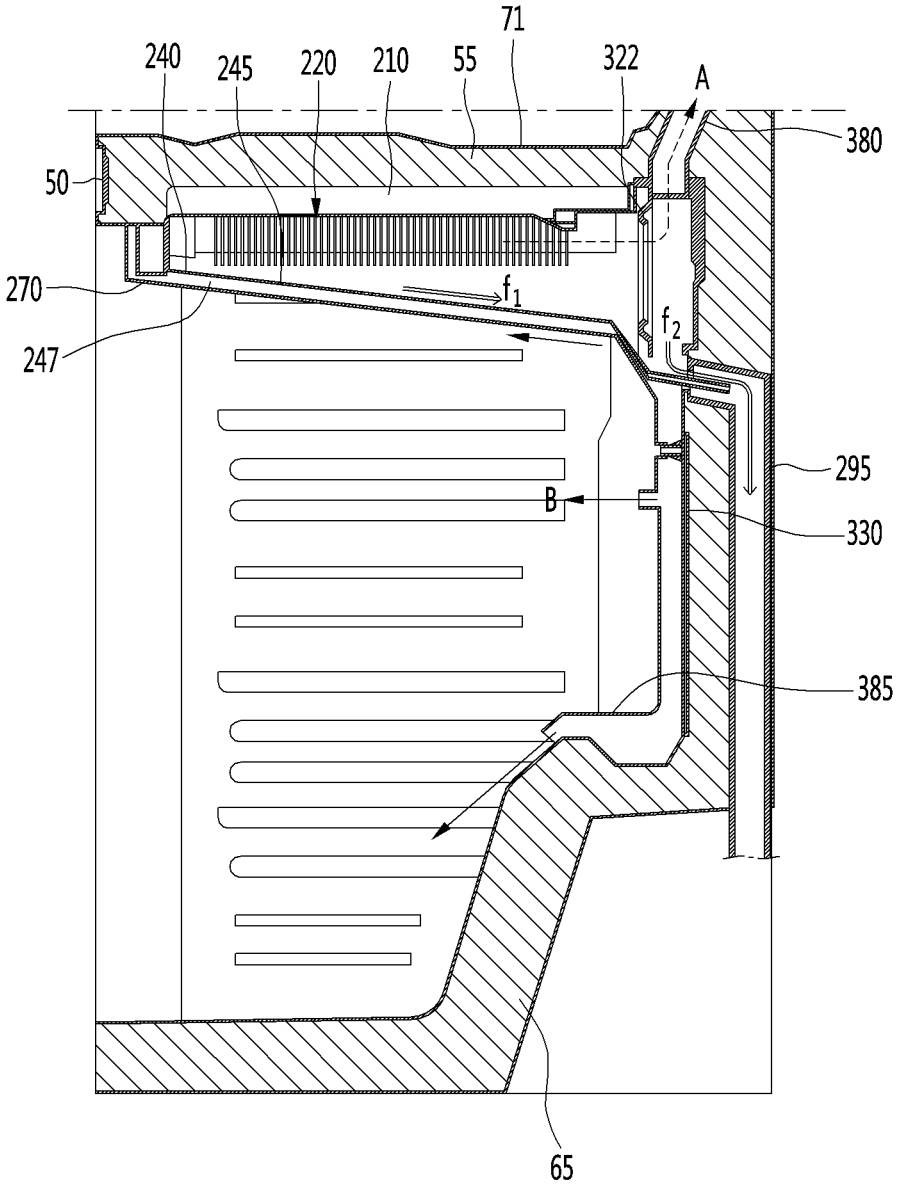
FIG. 18 illustrates a state in which defrosting water generated by the evaporator is discharged according to the embodiment.

Further, to further increase the volumes of the storage chambers 12 and 13, a portion of the partition wall 50 may be recessed, and the heat exchange chamber may be arranged at the recessed portion of the partition wall 50. As an example, as illustrated in FIG. 18, the bottom surface of the partition wall 50 may be inclined upward, and the first cover of the cold air generator 200 may be inserted into the recessed portion of the partition wall 50.

To sufficiently secure the cold air suction passage to the heat exchange chamber, the cold air inlets (discharge holes) 312 of the first storage chamber may be formed on lateral sides rather than a front side of the cold air generator 200 or the first storage chamber 12. As another example, auxiliary cold air inlets (through-holes) 271*a* may be formed on the front side of the cold air generator 200 and guide flow of the cold air together with the cold air inlets 312 on the lateral sides of the cold air generator 200.

When the cold air inlets are formed on lateral sides of the first storage chamber 12, the fins 223 of the evaporator 220 may extend from the lateral side toward the central portion of the evaporator 220 such that flow loss of the cold air introduced into the heat exchange chamber through the cold air inlets is minimized within the heat exchange chamber. In this case, the cold air inlets (cover discharge holes) 275 of the freezing chamber 13 may also be formed on the lateral sides of the second storage chamber 13, and the cold air may be introduced toward a central portion of the heat exchange chamber.

When the cold air inlets 312 of the first storage chamber 12 are formed on the lateral sides of the first storage chamber 12, the cold air inlets 312 may be formed on the bottom surface or the side walls of the first storage chamber 12. Further, to prevent the cold air inlets 312 from being blocked by stored goods stored in the first storage chamber 12, a forming portion may be formed near the cold air inlets 312 or the cold air inlets 312 may be spaced apart from the bottom surface of the first storage chamber 12 by a predetermined distance.

Because the partition wall insulator 55 is provided between the cold air inlets 312 and the heat exchange chamber (or the cold air generator 200), a passage may be formed by connecting the cold air inlets 312 and the heat exchange chamber to each other. To achieve this, the separate discharge ducts 311 may be configured to connect the cold air inlets 312 and the heat exchange chamber to each other, and according to such a configuration, the thickness of the partition wall insulator 55 may be minimized so that the volumes of the storage chambers may be increased. As another example, a portion of the interior of the partition wall insulator 55 may be penetrated without a separate structure such as the discharge ducts 311.

When the heat exchange chamber is installed inside the partition wall 50 or on one side of the partition wall 50, to improve production convenience, an upper portion of the heat exchange chamber may face the partition wall 50, a wall, that is, the inner refrigerating chamber case 71, defining the partition wall 50 may be utilized as an upper cover (the first cover) 210 of the heat exchange chamber, or a separate cover may be provided. Further, a lower cover (the second cover 270) may be provided on a lower side of the heat exchange chamber to be fastened to the inner refrigerating chamber case 71.

In detail, the cold air stored in the storage chambers 12 and 13 according to the embodiment may be introduced into the evaporation chamber in which the evaporator 220 is located, through each suction passage. The cold air stored in the refrigerating chamber 12 may be introduced into the evaporation chamber through the discharge ducts 311 constituting the refrigerating chamber suction passage (dotted line arrow). Further, the cold air stored in the freezing chamber 13 may be introduced into the evaporation chamber through the cover discharge holes 275 constituting the freezing chamber suction passage (solid line arrow).

As described above, the cover discharge holes 275 may be located relatively in front of the discharge ducts 311. Thus, the cold air in the freezing chamber, which is introduced into the evaporation chamber through the cover discharge holes 275, may be heat-exchanged while flowing from the front side toward the rear side of the evaporator 220. Thus, the heat exchange area of the cold air in the freezing chamber may be relatively large.

Thus, the cold air in the refrigerating chamber, which is introduced into the evaporation chamber through the discharge ducts 311, may be heat-exchanged while flowing from an approximately central portion toward the rear side of the evaporator 220. Thus, the heat exchange area of the cold air in the refrigerating chamber may be smaller than the heat exchange area of the cold air in the freezing chamber. However, cooling load of the cold air in the refrigerating chamber may not be larger than cooling load of the cold air in the freezing chamber, so that even when the suction passages are arranged as described above, sufficient cooling performance may be secured.

The plurality of fins 223 of the evaporator 220 may be spaced apart from each other from the front side toward the rear side of the evaporator 220. That is, the plurality of fins 223 may form a plurality of rows in the first direction. Further, front surfaces of the fins 223 constituting the rows may be arranged face a front side.

As an example, the front surfaces of the fins 223 constituting the plurality of rows may extend in parallel to each other in a transverse direction. According to such arrangement of the fins 223, the cold air flowing from the lateral sides of the evaporator 220 toward the central portion of the evaporator 220, that is, toward the fan suction passage 227 may be not interfered by the fins 223. As a result, the fins 223 may easily guide the flow of the cold air.

Such flow of the cold air may be performed on the opposite sides of the evaporator 220 through the first and second heat exchangers 220*a* and 220*b*. The cold air introduced from the opposite sides of the evaporator 220 may pass through the refrigerant pipes 221 and the fins 223, be combined with the fan suction passage 227, and then flow rearward.

Further, the cold air of the fan suction passage 227 may be introduced into the grill covers 320 and 330 through the fan suction part 322 and pass through the blowing fan 350. At least a portion of the cold air passing through the blowing fan 350 may flow to the refrigerating chamber cold air duct 81 through the first supply duct 380 and may be supplied to the refrigerating chamber 12 through the refrigerating chamber cold air supplying ports 82 (see arrow A of FIG. 18). The remaining cold air among the cold air passing through the blowing fan 350 may flow to the first and second supply ports 325 and 326 or the second supply duct 385 and may be supplied to the freezing chamber 13 (see arrow B of FIG. 18).

While the cold air is supplied through the evaporator 220, the condensed water f2 or the defrosting water f1 may be generated by the evaporator 220, and the condensed water or the defrosting water may fall down to the defrosting water tray 240 provided below the evaporator 220. The water collected in the defrosting water tray 240 may flow toward the rear side of the defrosting water tray 240.

As described above, the defrosting water tray 240 may be inclined downward from the front side toward the rear side thereof, so that the condensed water or the defrosting water may easily flow. The water flowing through the defrosting water tray 240 may pass through the grill covers 320 and 330, and is introduced into the drain pipe 295.

The condensed water f2 generated by the blowing fan 350 or in the grill covers 320 and 330 may fall down to the defrosting water tray 240 through the condensed water hole 338 and may be introduced into the drain pipe 295. The defrosting water f1 and the condensed water f2 may be combined with each other in the defrosting water tray 240 and may be introduced into the drain pipe 295.

The water introduced into the drain pipe 295 may flow downward to be introduced into the machine room 80, and may be collected in the drain fan provided in the machine room 80. According to such an operation, the defrosting water may be easily discharged.

Figure 19:
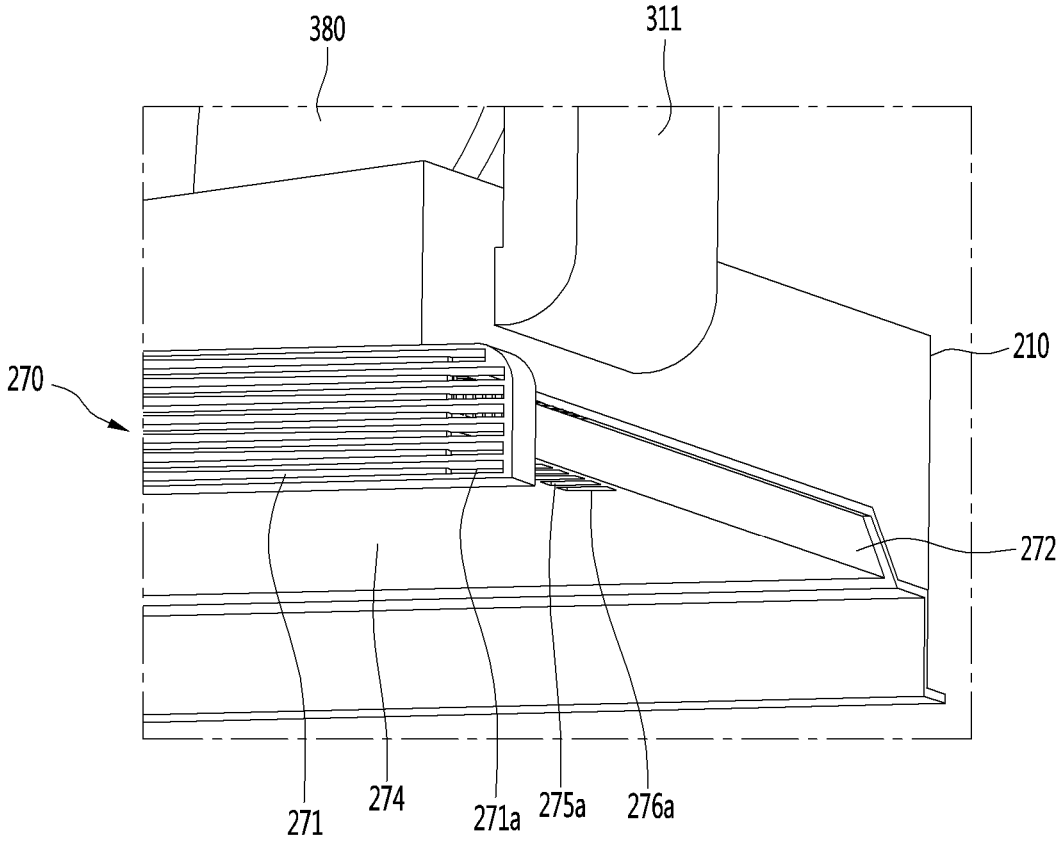
FIG. 19 illustrates configurations of components constituting a cold air suction passage according to another embodiment.

Referring to FIG. 19, a second bottom cover part (or second bottom cover) 274 of a second cover 270 according to another embodiment may include cover discharge holes 275*a* through which the cold air in the freezing chamber 13 is introduced into the heat exchange chamber. The cover discharge holes 275 described in the first embodiment may be formed in the second bottom cover 274.

A plurality of second grills 276*a* may be provided in the cover discharge holes 275*a* to prevent foreign substances existing in the freezing chamber 13 from being introduced into the heat exchange chamber through the cover discharge holes 275*a*. The cold air introduced into the opposite side parts 220*a* and 220*b* of the evaporator 220 through the cover discharge holes 275*a* may flow to and be combined with the central part 220*c* of the evaporator 220 and may then flow to the blowing fan 350.

In comprehensive descriptions of the contents described in the embodiments, the cover discharge holes 275 and the cover discharge holes 275*a* may be formed on lateral sides of the freezing chamber 13. The cover discharge holes 275 may be arranged on the lateral sides of the second cover 270, and the cover discharge holes 275*a* may be arranged on the bottom surface of the second cover 270. Further, because such cover discharge holes are formed on opposite sides of the cold air supplying device, the cold air in the freezing chamber 13 may be easily introduced into the heat exchange chamber.

A refrigerator may include a heat exchange chamber, first inlets arranged on side surfaces of a first storage chamber and configured to introduce cold air in the first storage chamber into the heat exchange chamber, and second inlets arranged on side surfaces of a second storage chamber and configured to introduce cold air in the second storage chamber into the heat exchange chamber. The refrigerator may further include an evaporator arranged in the heat exchange chamber and having refrigerant pipes through which refrigerant flows and fins configured to guide heat exchange between the refrigerant and the cold air.

The evaporator may include side parts located to be adjacent to the first inlets or the second inlets and located at an upper stream of the cold air flowing toward the fan and a central part located at a lower stream of the cold air flowing toward the fan. The fins may include guide fins extending from lateral sides to the central part of the evaporator and configured to guide flow of the cold air passing through the side parts.

The refrigerator may further include discharge ducts connected to the side parts of the heat exchange chamber and configured to supply air passing through the first inlets to the heat exchange chamber. Evaporator cases may include a first cover covering an upper side of the evaporator. The evaporator cases may include a second cover supporting a lower side of the evaporator.

An inner refrigerating chamber case defining the refrigerating chamber and an inner freezing chamber case defining the freezing chamber may be included, and the partition wall insulator may be installed between the inner refrigerating chamber case and the inner freezing chamber case.

The first cover may define at least a portion of the inner freezing chamber case.

A refrigerating chamber suction passage may further include discharge ducts configured to supply the cold air in the refrigerating chamber toward the evaporator. The discharge ducts may include discharge holes communicating with the refrigerating chamber and evaporator supply parts coupled to first duct coupling port of the first cover.

A freezing chamber suction passage may include cover discharge holes formed in the second cover and configured to supply cold air in the freezing chamber toward the evaporator. The first duct coupling port may be arranged on side surfaces of the first cover, and the cover discharge holes may be arranged on side surfaces of the second cover.

The refrigerating chamber suction passage and the freezing chamber suction passage may be formed at different locations with respect to a front-rear direction. The freezing chamber suction passage may be located in front of the refrigerating chamber suction passage.

The first duct coupling port and the cover discharge holes may intersect each other in a front-rear direction. The cover discharge holes may be located in front of the first duct coupling port with respect to a vertical reference line.

The cold air supplied toward the evaporator through the cover discharge holes may pass through a front portion of the evaporator, and the cold air supplied toward the evaporator through the first duct coupling port may pass through the central part of the evaporator. A front-rear directional center C2 of the cover discharge holes may be formed in front of a front-rear directional center C1 of the first duct coupling port.

A front end of the cover discharge holes may be located in front of a front end of the first duct coupling port, and a rear end of the cover discharge holes may be located in front of a rear end of the first duct coupling port. The refrigerator may further include a defrosting water tray provided below the evaporator and a tray insulator arranged below the defrosting water tray and supported by the second cover.

The refrigerator may further include a first defrosting heater coupled to the evaporator. The refrigerator may further include a second defrosting heater arranged between the defrosting water tray and the tray insulator. The refrigerator may further include a flow supply unit coupled to a rear side of the evaporator cases, configured to supply the cold air passing through the evaporator to the refrigerating chamber and the freezing chamber, and having a blowing fan.

The flow supply unit may further include grill covers accommodating the blowing fan, and the grill covers may include a fan suction part configured to guide the cold air to the blowing fan and a plurality of cold air supplying parts through which the cold air passing through the blowing fan is supplied to the freezing chamber. The flow supply unit may further include a first supply duct coupled to an upper side of the grill covers and configured to guide the cold air passing through the blowing fan to the refrigerating chamber.

The flow supply unit may further include a second supply duct coupled to a lower side of the grill covers and configured to guide the cold air passing through the blowing fan to the freezing chamber. The flow supply unit may further include a drain pipe provided on a rear side of the grill covers and configured to guide discharge of condensed water generated by the evaporator or the blowing fan.

According to the refrigerator having the above-described configuration, because an evaporator may be installed on one side of a partition wall by which a refrigerating chamber and a freezing chamber are vertically partitioned, an internal storage space of the refrigerator may be enlarged, and withdrawal distances of drawers provided in the refrigerator may be increased. Thus, storage space for food may be increased.

Further, because a freezing chamber suction passage through which cold air is introduced from the freezing chamber into the evaporator and a refrigerating chamber suction passage through which cold air is introduced from the refrigerating chamber into the evaporator may be vertically arranged, flow resistance between the cold air introduced through the freezing chamber suction passage and the refrigerating chamber suction passage may be prevented from being generated. Thus, collision loss between the freezing chamber suction passage and the refrigerating chamber suction passage may be reduced and the cold air may uniformly pass through the evaporator, so that heat exchange efficiency of the evaporator may be improved.

The freezing chamber suction passage may be located in front of the partition wall, and the refrigerating chamber suction passage may be located behind the freezing chamber suction passage, so that while the cold air flows from an inner front side to a rear side of the partition wall, the cold air introduced through the freezing chamber suction passage may pass through the relatively large heat exchange area of the evaporator. The heat exchange area of the cold air introduced through the freezing chamber suction passage may be increased, so that cooling performance may be improved.

An amount of the cold air supplied to the freezing chamber may be larger than an amount of the cold air supplied to the refrigerating chamber, so that an increase in the temperature of the freezing chamber that should be maintained at a relatively low temperature may be prevented. Further, the evaporator may include a first heat exchanger and a second heat exchanger spaced apart from each other, and a fan suction passage through which the cold air is sucked into a fan may be provided between the first and second heat exchangers, so that the cold air introduced from opposite sides of the partition wall may easily flow towards the fan located on a rear side of the partition wall.

The first and second heat exchangers may be inclined from a central portion toward lateral sides of the evaporator, so that the heat exchange area of the evaporator may be increased, and the relatively large thickness of an insulator located in the partition wall may be secured. Further, a defrosting water tray may be provided on a lower side of the evaporator, and the defrosting water tray may be inclined downward from opposite sides to the central portion to correspond to the shape of the evaporator, so that defrosting water may smoothly flow.

Because a recessed part is formed at a central portion of the defrosting water tray and the fan suction passage is formed above the recessed part, the defrosting water stored in the defrosting water tray may be applied to the evaporator even when an amount of the defrosting water is increased, so that frost may be prevented from being generated at a lower portion of the evaporator.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a first storage chamber;

a second storage chamber provided below the first storage chamber;

a case defining a heat exchange chamber provided between the first and second storage chambers, the case including a bottom wall, a side wall, and a top wall;

a fan provided at a side of the heat exchange chamber and configured to blow cold air from the heat exchange chamber to the first and second storage chambers;

an evaporator provided in the heat exchange chamber; and a first duct coupling port and a second storage chamber inlet, the first duct coupling port being formed at the side wall to allow air in the first storage chamber to be introduced into the heat exchange chamber, and the second storage chamber inlet being formed at one of the bottom wall or the side wall to allow air in the second storage chamber to be introduced into the heat exchange chamber.

2. The refrigerator of claim 1, wherein the first duct coupling port and the second storage chamber inlet are arranged to be at least partially aligned in a first direction.

3. The refrigerator of claim 1, wherein a front end of the first duct coupling port is not aligned with that of the second storage chamber inlet.

4. The refrigerator of claim 1, wherein the front end of the second storage chamber inlet is located closer to a front of the case than that of the first duct coupling port, and the fan is provided at a rear of the heat exchange chamber.

5. The refrigerator of claim 1, wherein a rear end of the first duct coupling port is not aligned with that of the second storage chamber inlet.

6. The refrigerator of claim 1, wherein a rear end of the second storage chamber inlet is located closer to a front of the case than that of the first duct coupling port.

7. The refrigerator of claim 1, wherein the first and the second storage chamber inlet are arranged such that a heat exchange area of the air flowing through the second storage chamber inlet with the evaporator is greater than that of the air flowing through the first duct coupling port with the evaporator.

8. The refrigerator of claim 1, wherein the first duct coupling port and the second storage chamber inlet are formed at the side wall of the case.

9. The refrigerator of claim 8, wherein the first duct coupling port is provided at a height higher than a height of the second storage chamber inlet.

10. The refrigerator of claim 1, wherein the side wall includes a pair of side walls, the first duct coupling port includes a pair of the first duct coupling ports formed at the pair of side walls, and the second storage chamber inlet includes a pair of the second storage chamber inlets formed at the pair of side walls.

11. The refrigerator of claim 1, wherein the first duct coupling port and the second storage chamber inlet are located closer to a front of the heat exchange chamber than a rear of the heat exchange chamber.

12. The refrigerator of claim 1, further comprising a discharge duct extending between and communicating with the first storage chamber and the first duct coupling port to allow air in the first storage chamber to flow to the first duct coupling port.

13. The refrigerator of claim 1, wherein the case includes at least one cover to shield a top or a bottom of the evaporator.

14. The refrigerator of claim 1, further comprising:

a cabinet including a first inner case defining the first storage chamber and a second inner case defining the second storage chamber, and an insulator provided between the first inner case and the second inner case.

15. A refrigerator comprising:

a first storage chamber;

a second storage chamber provided below the first storage chamber;

a partition wall provided between the first and second storage chambers;

a heat exchange chamber provided at the partition wall and including a bottom wall, a side wall, and a top wall;

a fan provided at a side of the heat exchange chamber and configured to blow cold air from the heat exchange chamber to the first and second storage chambers;

an evaporator provided in the heat exchange chamber; and a second storage chamber inlet formed at the side wall, the second storage chamber inlet being configured to allow the air in the second storage chamber to be introduced into the heat exchange chamber.

16. The refrigrator of claim 15, wherein the first inlet is located closer to a front of the heat exchange chamber than a rear of the heat exchange chamber.

17. The refrigerator of claim 15, wherein the side wall includes a pair of sidewalls, and the second storage chamber inlet comprises a plurality of openings provided at the pair of side walls.

18. The refrigerator of claim 15, further comprising a first duct coupling port formed at the side wall, the first duct coupling port being configured to allow the air in the first storage chamber to be introduced into the heat exchange chamber.

19. The refrigerator of claim 18, wherein at least a portion of the second storage chamber inlet is provided under a portion of the first duct coupling port.

20. A refrigerator, comprising:

a refrigerating compartment;

a freezing compartment;

a partition wall provided between the refrigerating compartment and the freezing compartment;

a case provided in the partition wall, the case having a bottom wall, a side wall, and a top wall;

a fan provided at a rear of the case configured to suction air from inside the case and blow air into at least one of the refrigerating compartment or the freezing compartment;

an evaporator provided inside of the case; and at least one opening formed at the side wall at a position closer to the front than the rear, the at least one opening including a first duct coupling port communicating with the refrigerating compartment or a second storage chamber inlet communicating with the freezing compartment.

* * * * *